US010842340B2

(12) United States Patent
Morad

(10) Patent No.: US 10,842,340 B2
(45) Date of Patent: Nov. 24, 2020

(54) HAND OPERATED DISPOSABLE CLOTH REMOVAL APPARATUS FOR A FLAT MOP

(71) Applicant: Tranzonic Companies, Cleveland, OH (US)

(72) Inventor: Fred I. Morad, Toluca, CA (US)

(73) Assignee: TRANZONIC COMPANIES, Cleveland, OH (US)

( * ) Notice: Subject to any disclaimer, the term of this patent is extended or adjusted under 35 U.S.C. 154(b) by 238 days.

(21) Appl. No.: 15/999,549

(22) Filed: Aug. 20, 2018

(65) Prior Publication Data

US 2019/0117034 A1 Apr. 25, 2019

Related U.S. Application Data

(63) Continuation of application No. 15/790,972, filed on Oct. 23, 2017, now Pat. No. 10,052,006.

(Continued)

(51) Int. Cl.

| | |
|---|---|
| ***A47L 13/12*** | (2006.01) |
| ***A47L 13/256*** | (2006.01) |
| ***A47L 13/44*** | (2006.01) |
| ***A47L 13/254*** | (2006.01) |
| ***B25G 3/36*** | (2006.01) |

(Continued)

(52) U.S. Cl.

CPC ..... *A47L 13/12* (2013.01); *A47L 11/4041* (2013.01); *A47L 13/254* (2013.01); *A47L 13/256* (2013.01); *A47L 13/31* (2013.01); *A47L 13/44* (2013.01); *B25G 3/36* (2013.01); *B25G 3/38* (2013.01); *A47L 13/14* (2013.01)

(58) Field of Classification Search

CPC ..... A47L 13/31; A47L 13/44; A47L 11/4041; A47L 13/256; A47L 13/12; A47L 13/254; A47L 13/14; B25G 3/36; B25G 3/38

See application file for complete search history.

(56) References Cited

U.S. PATENT DOCUMENTS 8,677,547 B1 * 3/2014 Morad ..... H04L 51/32 15/147.1
8,800,092 B1 * 8/2014 Morad ..... A47L 13/256 15/147.1

(Continued)

*Primary Examiner* — Shay Karls

(74) *Attorney, Agent, or Firm* — Taft Stettinius & Hollister LLP; Ryan O. White; Daniel J. Krieger

(57) ABSTRACT

A mop, including an elongated handle having a socket assembly affixed to a first end thereof; a plurality of grasping members extending from the socket assembly; a stationary plate removably attachable to the elongated handle; a ball assembly extending from a top portion of the stationary plate, the ball assembly being configured to engage the grasping members to achieve the removable attachment to the elongated handle; a trigger mechanism positioned along the top portion of the stationary plate, the trigger mechanism being axially movable relative to the ball assembly; a push plate movably coupled to the stationary plate, the push plate being configured to move from a first position proximate the stationary plate to a second position axially away from the stationary plate in response to activation of the trigger mechanism; and a substrate removably coupled to the push plate, wherein the substrate is configured to decouple from the push plate once the push plate is moved to the second position in response to activation of the trigger mechanism.

14 Claims, 30 Drawing Sheets

Related U.S. Application Data

(60) Provisional application No. 62/412,776, filed on Oct. 25, 2016.

(51) Int. Cl.

| | |
|---|---|
| ***A47L 11/40*** | (2006.01) |
| ***A47L 13/31*** | (2006.01) |
| ***B25G 3/38*** | (2006.01) |
| *A47L 13/14* | (2006.01) |

(56) References Cited

U.S. PATENT DOCUMENTS

| | | | | |
|---|---|---|---|---|
| 9,072,419 | B1 * | 7/2015 | Morad | A47L 13/256 |
| 2015/0208893 | A1 * | 7/2015 | Stephens | A47L 13/24 134/6 |

* cited by examiner

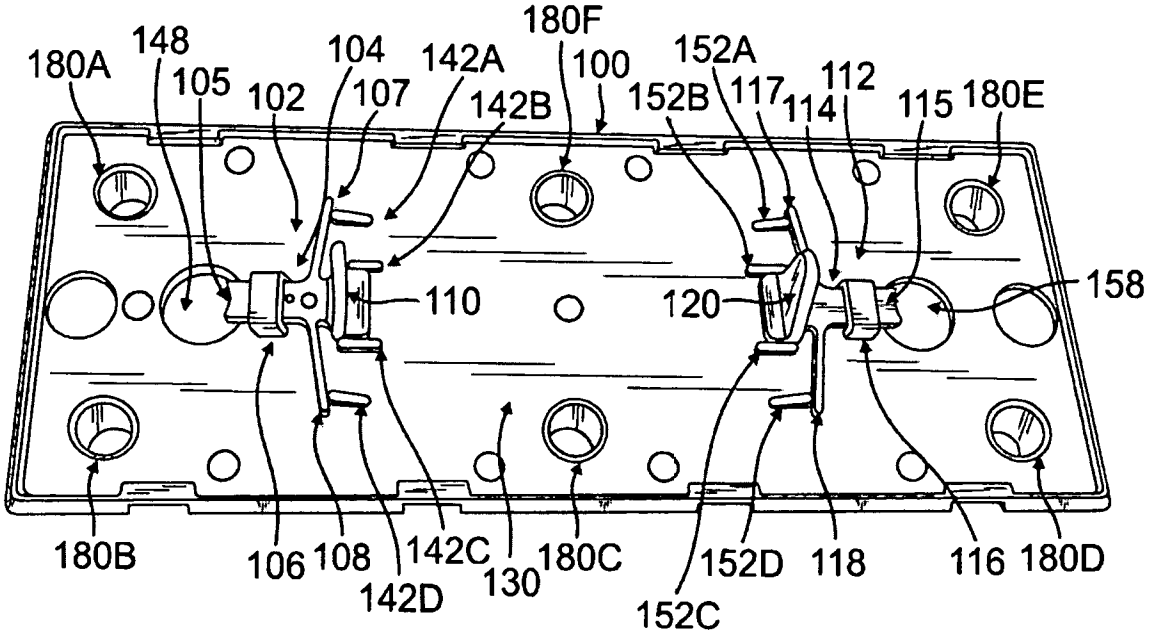
FIG. 4A1

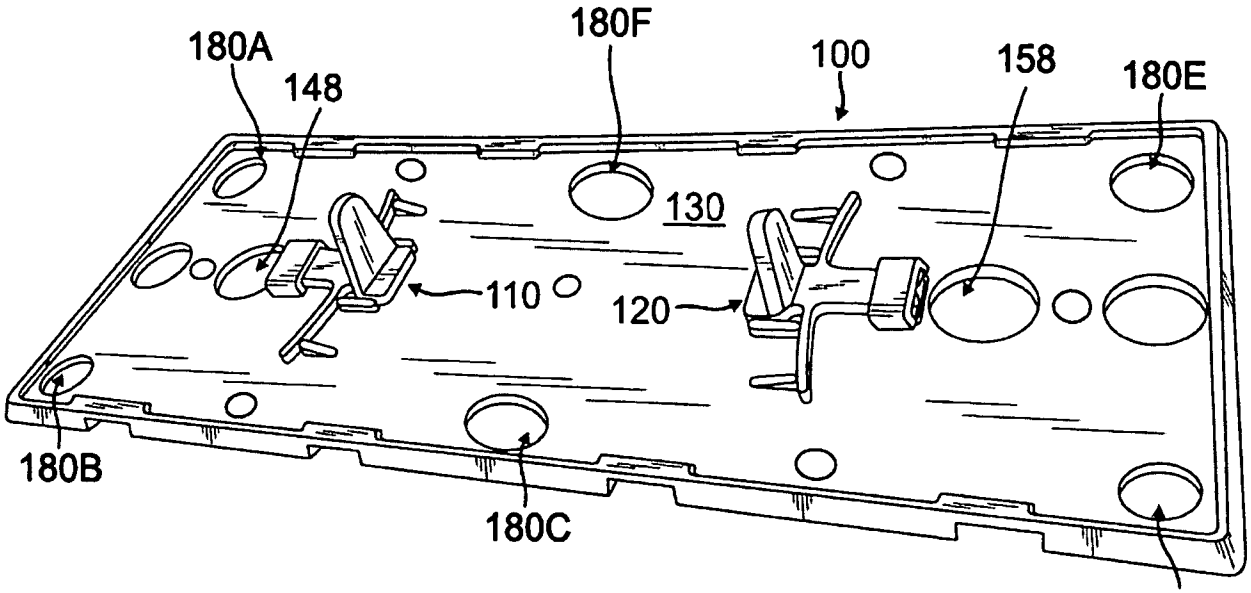
FIG. 4A2

HAND OPERATED DISPOSABLE CLOTH REMOVAL APPARATUS FOR A FLAT MOP

CROSS-REFERENCE TO RELATED APPLICATIONS

This application is a continuation of U.S. patent application Ser. No. 15/790,972 filed on Oct. 23, 2017, and which in turn claims the benefit of U.S. Provisional Patent Application Ser. No. 62/412,776, which was filed on Oct. 25, 2016. The present application hereby expressly incorporates by reference the complete disclosure of each of these applications in their entities.

BACKGROUND OF THE INVENTION

1. Field of the Invention

The present invention relates to the field of hand-operated flat mops which retain a disposable cleaning cloth used to scrub and clean surfaces such as floors.

2. Description of the Prior Art

The present inventor Fred I. Morad is a co-inventor of the invention entitled U.S. Pat. No. 8,800,092 for "APPARATUS TO REMOVE A DISPOSABLE CLOTH FROM A HAND OPERATED FLAT MOP THROUGH A SINGLE TRIGGER MECHANISM WITHOUT HAVING TO TOUCH THE DISPOSABLE CLOTH" issued on Aug. 12, 2014.

The present inventor Fred I. Morad is also aware of pending patent application Ser. No. 14/596,325, Publication No. 2015/0208893 filed by Stephens et al. for "APPARATUS AND METHOD FOR PREPARING A SURFACE".

SUMMARY OF THE INVENTION

The present invention is a dual trigger mechanism to release a disposable microfiber cloth or non-woven cloth from a flat mop combined with a ball and socket assembly. The present invention includes one or more of the following components or features: (1) a socket affixed to a handle and a ball affixed to a top plate of the mop with the socket movably grasping the ball; (2) a top plate; (3) a mechanical plate with a dual trigger mechanism incorporated into the mechanical plate; (4) a push plate; and (5) a pad made of material such as foam or rubber below the push plate. In one variation, the invention retains a microfiber cloth, a wiping material, a cleaning material or cloth made out of similar material. In an alternative variation, the invention retains a non-woven cloth or cloth made out of similar material.

The top plate is stationary with respect to other components and provides a base to which the other components are coupled. It has a flat top surface with a ball located at a center of the top plate. The ball is attached to a cylindrical stem or comparable ball extension member which extends through a central opening in the top plate. The extension member and the opening in the top cover, in one embodiment, are the same shape or similar shape to provide a cooperative interaction therebetween. If the extension member is not round, then the opening in the top plate is configured to be able to receive the extension member. The ball extension member is held in place by at least one grasping member within the central opening and the extension member is fixed in place, with an adhesive, threads, or connector, for instance, in place in the central opening in the top plate and/or the ball is fixed to the top surface of the top plate. The ball removably receives a socket affixed to the bottom of the mop handle. When the socket engages the ball, the mop handle is able to rotate three-hundred sixty (360) degrees in one or more directions with respect to the top plate. Therefore, a user grasping the handle can push and pull the mop back and forth in any direction when cleaning a flat surface such as a floor.

The top plate also includes spaced apart trigger activation member or squeeze member openings spaced at opposite sides of the ball and extending through the thickness of the top plate. In one embodiment, the squeeze member openings are equidistant on opposite sides of the ball. A first trigger activation member extends through a first activation member opening and a second trigger activation member extends through a second activation member opening. Each trigger activation member extends at or near perpendicular with respect to the upper surface of the top plate. The first and second trigger activation members are substantially parallel to each other. Each respective trigger mechanism opening is sufficiently wide to enable each respective trigger mechanism to be pushed toward the ball, or alternatively squeezed between two fingers to push each respective trigger activation member toward the ball.

The top plate also includes a first ratchet collar cover located on the same side as and spaced apart from the first trigger activation member opening, and closer to the first end of the top plate. The top plate also includes a second ratchet collar cover located on the same side as and spaced apart from the second trigger activation member opening, and closer to the second end of the top plate. Each respective ratchet collar cover is respectively spaced apart from a respective trigger activation member opening and each is further away from the ball.

The top plate has a bottom surface which includes a first compression spring housing supporting the top of a first compression spring and a second compression spring housing supporting the top of a second compression spring.

The push plate is designed to facilitate the retention of the wiping cloth, such as the microfiber cloth or non-woven cloth and facilitate the removal of a dirty cloth without a user's hand touching the cloth. There are different variations of the push plate. Each variation includes some of the same components. Affixed to the top surface of the push plate is a first ratchet collar vertically aligned with the first ratchet collar cover of the top plate and spaced apart from the first operating trigger assembly of the first trigger mechanism on the mechanical plate. The first ratchet collar has a sidewall with a first ratchet notch which receives a first notch tooth from the first trigger mechanism. The first ratchet collar extends through aligned openings in the mechanical plate and the top plate and is received in the first ratchet collar cover on the top plate. Similarly, affixed to the top surface of the push plate is a second ratchet collar vertically aligned with the second ratchet collar cover of the top plate and spaced apart from the second operating trigger assembly of the second trigger mechanism on the mechanical plate. The second ratchet collar has a sidewall with a second ratchet notch which receives a second notch tooth from the second trigger mechanism. The second ratchet collar extends through aligned openings in the mechanical plate and the top plate and is received in the second ratchet collar cover on the top plate.

Affixed to the top surface of the push plate and spaced apart from the first ratchet collar is a first bottom compression spring housing retaining the bottom of the first compression spring extending through an aligned first spring opening in the mechanical plate and retained in the vertically aligned first top compression spring housing on the bottom surface of the top plate. Similarly, affixed to the top surface of the push plate and spaced apart from the second ratchet collar is a second bottom compression spring housing retaining the bottom of the second compression spring extending through an aligned second spring opening in the mechanical plate and retained in the vertically aligned second top compression spring housing on the bottom surface of the top plate.

A first mechanical fastening member (such as a fastening pin) has a top end and a bottom end and extends from its bottom end affixed within the push plate and extends through the push plate, through an aligned opening in the mechanical plate and into an aligned opening within the first ratchet collar and having its top end retained within the first ratchet collar.

Similarly, a second mechanical fastening member (such as a fastening pin) has a top end and a bottom end and extends from its bottom end affixed within the push plate and extends through the push plate, through an aligned opening in the mechanical plate and into an aligned opening within the second ratchet collar and having its top end retained within the second ratchet collar.

A first pin retaining member (such as a Tinnerman Clip) retains the first mechanical fastening member at the bottom surface of the push plate and within the first ratchet collar and a second pin retaining member (such as a Tinnerman Clip) retains the second mechanical fastening member at the bottom surface of the push plate and within the second ratchet collar.

The variations on the push plate have the following differences. In a first variation, the push plate facilitates the retention of a microfiber cloth and has a multiplicity of openings to enable microfiber cloth retention members extending from the bottom of the mechanical plate to engage and retain the microfiber cloth. In one embodiment of the present invention, there are six openings, three in one row and three in an opposite parallel row with an opening in one row aligned with an opening in the second row. Six respective aligned posts each having a mating hook fastener at its distal end extending from the bottom surface of the mechanical plate through a respective opening in the push plate to retain the microfiber cloth.

In the first variation of the push plate, a bottom surface has a multiplicity of ribs to facilitate retention of a pad such as a rubber or foam pad with adhesive applied to the ribs against the bottom surface of the push plate. The rubber or foam pad has a multiplicity of openings respectively aligned with the openings in the push plate to enable the microfiber cloth retention members to extend through the pad and to engage and retain the microfiber cloth.

In the second variation, the top surface of the push plate has a multiplicity of aligned teeth adjacent respective parallel longitudinal sides of the push plate and corresponding with aligned openings in the bottom of the mechanical plate. A non-woven cloth is wrapped around the push plate, partially retained by the aligned parallel rows of teeth and retained by a press fit between the push plate and the mechanical plate.

The last component is the mechanical plate which is stationary and affixed to the bottom of the top plate. A first ratchet collar opening in the mechanical plate enables the first ratchet collar to extend through this aligned opening in the mechanical plate and rest within the first ratchet collar cover and a second ratchet collar opening in the mechanical plate enables the second ratchet collar to extend through this aligned opening in the mechanical plate and rest within the second ratchet collar cover.

A first compression spring opening in the mechanical plate enables the first compression spring to extend from the first bottom compression spring housing on the push plate through the first compression spring opening in the mechanical plate into the first top compression spring housing on the top plate. Similarly, a second compression spring opening in the mechanical plate enables the second compression spring to extend from the second bottom compression spring housing on the push plate through the second compression spring opening in the mechanical plate into the second top compression spring housing on the top plate.

The top surface of the mechanical plate includes a first trigger mechanism having a first "L"-shaped member with an upper portion extending through a first trigger activation mechanism opening in the top to enable the upper portion of the first "L"-shaped member to extend perpendicular to the top plate. The horizontal portion of the first "L"-shaped member extends to engage a first transverse trigger mechanism spring member, is further aligned with a first stop member on the top surface of the mechanical plate and at its end forms a first notch tooth which extends into the first ratchet notch of the first ratchet collar. Similarly, the second trigger mechanism includes a second "L"-shaped member with an upper portion extending through a second trigger activation mechanism opening in the top plate to enable the upper portion of the second "L"-shaped member to extend perpendicular to the top plate. The horizontal portion of the second "L"-shaped member extends to engage a second transverse trigger mechanism spring member, is further aligned with a second stop member on the top surface of the mechanical plate and at its end forms a second notch tooth which extends into the second ratchet notch of the second ratchet collar.

The mechanical plate is retained into or onto the top plate by mating notch and tooth members along the bottom wall of the top plate and along exterior portions of the mechanical plate.

In operation, the first transverse spring member forces the first notch tooth into the first ratchet notch of the first ratchet collar and the second transverse spring member forces the second notch tooth into the second ratchet notch of the second ratchet collar.

A concurrent squeezing force of the upper "L"-shaped members of the first and second trigger activation members forcing the first trigger activation member to move toward the center ball and forcing the second trigger activation member to move toward the center ball, concurrently causing the first ratchet tooth to be removed from the first ratchet notch of the first ratchet collar and the second ratchet tooth to be removed from the second ratchet notch of the second ratchet collar. The force of the first compression spring and the second compression spring forces the push plate to move away from the mechanical plate. The cloth which was retained against the bottom surface of the push plate by either being retained by the hook fasteners for a microfiber cloth or retained by being wrapped around the push plate and press fit retained between the push plate and the mechanical plate for a non-woven cloth is released and the retention force, either hook or press-fit is removed and the cloth falls away to a trash receptacle.

Also described, when the upper portion of each "L"-shaped member of the dual trigger activation mechanism is pushed inwardly toward the ball, each respective transverse trigger mechanism spring member bows inwardly away from a respective ratchet collar and is placed into tension and at the same time each respective ratchet tooth is removed from the respective ratchet notch in the respective ratchet collar. As a result, the force which retained the compression springs under compression is removed and the compression springs which were in a compressed state move to an uncompressed state, causing the push plate to move away from the mechanical plane by a given distance thereby releasing the retention force which retained the cloth and the cloth falls away. The push plate does not complete fall away from the mechanical plate but instead is retained a short distance "D-1" from the mechanical plate by the two fastening pins extending from the bottom surface of the push plate to being retained in a respective ratchet collar. The distance "D-1" is sufficient to disengage the hook fasteners from the microfiber cloth so that the microfiber cloth falls away and is also sufficient to release the press fit between the push plate and the mechanical plate so the non-woven cloth falls away, without a user having to touch the dirty cloth.

When a new cloth is retained against the bottom of the push plate, the pushing force on the upper portion of each "L"-shaped member of the trigger mechanism is released, the tension force on each respective transverse trigger mechanism spring member is released and each respective transverse mechanism spring member bows outwardly toward each respective ratchet collar and each respective ratchet tooth engages into the respective ratchet notch in each respective ratchet collar and the new cloth is retained against the bottom of the push plate.

It is therefore provided in a least one embodiment of the present invention to combine a ball affixed to the mop top plate and a socket affixed to a handle with a mop having a dual release trigger mechanism as described above to enable a dirty cloth to be released from the mop without a user touching the dirty cloth. While a ball is generally described herein, other spheres or spheroids are contemplated.

In one embodiment, there is provided a mop configured to couple to a disposable cleaning cloth. The mop includes a ball and a mop handle including a socket disposed at an end of the handle. The socket includes one or more grasping members configured to partially surround the ball. A stem is coupled to the ball and extends therefrom. A top plate defines an opening, wherein the stem is located within the opening. The top plate further includes a trigger mechanism opening and a push plate is operatively connected to the top plate, wherein the push plate is displaceable with respect to the top plate. A trigger mechanism is spaced from at least one side of the ball and extends through the trigger mechanism opening, wherein the trigger mechanism is configured to displace the push plate with respect to the top plate.

Defined in detail, the present invention is a mop comprising: (a) a longitudinal mop handle with a bottom end, a socket affixed to the bottom end of the mop handle, the socket including a multiplicity of grasping members extending away from the bottom end of the mop handle; (b) a ball including a transverse cylindrical-shaped stem incorporated into and extending away from an outer surface of the ball, the gasping members movably affixed to the outer surface of the ball to facilitate rotation of the mop handle in any direction relative to the ball; (c) a stationary top plate having a top portion with a flat top surface with a ball stem receiving opening in the top plate, the ball receiving opening located at a longitudinal lengthwise center and width-wise center of the flat top surface, the ball stem receiving opening extending through a thickness of the top portion of the top plate, the ball stem receiving opening configured to received and retain the ball stem with the ball centrally positioned on the flat top surface; (d) the top plate also including spaced apart trigger activation member openings spaced at equidistant opposite sides of the ball and extending through the thickness of the top portion of the top plate, a first trigger activation member extends through a first activation member opening and a second trigger activation member extends through a second trigger activation member opening, each trigger activation member extending perpendicular to the upper surface of the top plate, the first and second trigger activation members are parallel to each other, each respective trigger member opening is sufficiently wide to enable each respective trigger member to be pushed toward the centrally located ball, the top plate also includes a first ratchet collar cover located on the same side as and spaced apart from the first trigger activation member opening and closer to a first end of the top plate, the top plate also including a second ratchet collar cover located on the same side as and spaced apart from the second trigger activation member opening and closer to a second end of the top plate, each respective ratchet collar cover is respectively spaced apart from a respective trigger activation member opening and each ratchet collar cover is further away from the centrally located ball; (e) the top plate having a bottom surface which includes a first compression spring housing supporting a top of a first compression spring and a second compression spring housing supporting a top of a second compression spring; (f) a mechanical plate retained onto a bottom portion of the top plate by mating notch members on the longitudinal sidewalls of the mechanical plate and tooth members along bottom longitudinal walls of the top plate; (g) the mechanical plate including a first trigger member having a first "L"-shaped member with an upper portion extending through the first trigger activation member opening in the top with the upper portion of the first "L"-shaped member extending perpendicular to the top plate, a horizontal portion of the first "L"-shaped member extending to engage a first transverse trigger member spring member, is further aligned with a first stop member on the top surface of the mechanical plate and at its distal end forms a first notch tooth, a second trigger member having a second "L"-shaped member with an upper portion extending through the second trigger activation member opening in the top with an upper portion of the second "L"-shaped member extending perpendicular to the top plate, a horizontal portion of the second "L"-shaped member extending to engage a second transverse trigger member spring member, is further aligned with a second stop member on the top surface of the mechanical plate and at its distal end forms a second notch tooth; (h) the mechanical plate including a first ratchet collar opening adjacent said first tooth, a second ratchet collar opening adjacent said second tooth, a first compression spring opening and a second compression spring opening; (i) a push plate having a top surface including a first ratchet collar vertically aligned with the first ratchet collar cover of the top plate and spaced apart from the first operating trigger assembly of the first trigger member on the mechanical plate, the first ratchet collar having a sidewall with a first ratchet notch which receives a first notch tooth from the first trigger member, the first ratchet collar extends through aligned openings in the mechanical plate and the top plate and is received in the first ratchet collar cover on the top plate, affixed to the top surface of the push plate is a second ratchet collar vertically aligned with the second ratchet collar cover of the top plate and spaced apart from the second operating trigger assembly of the second trigger member on the mechanical plate, the second ratchet collar has a sidewall with a second ratchet notch which receives a second notch tooth from the second trigger member, the second ratchet collar extends through aligned openings in the mechanical plate and the top plate and is received in the second ratchet collar cover on the top plate; (j) affixed to the top surface of the push plate and spaced apart from the first ratchet collar is a first bottom compression spring housing retaining a bottom of the first compression spring extending through an aligned first spring opening in the mechanical plate and retained in the vertically aligned first top compression spring housing on the bottom surface of the top plate, affixed to the top surface of the push plate and spaced apart from the second ratchet collar is a second bottom compression spring housing retaining a bottom of the second compression spring extending through an aligned second spring opening in the mechanical plate and retained in the vertically aligned second top compression spring housing on the bottom surface of the top plate; (k) a first mechanical fastening member with a longitudinal shaft having a top end and a bottom end and extending from its bottom end affixed within the push plate and extends through the push plate, through an aligned opening in the mechanical plate and into an aligned opening within the first ratchet collar and having its top end retained within the first ratchet collar, a second mechanical fastening member with a longitudinal shaft having a top end and a bottom end and extending from its bottom end affixed within the push plate and extending through the push plate, through an aligned opening in the mechanical plate and into an aligned opening within the second ratchet collar and having its top end retained within the second ratchet collar; (l) a first compression spring retained at its bottom end in the first compression spring housing in the push plate, the first compression spring extending through the first compression spring opening in the mechanical plate and retained at its top end in a first compression spring housing in the top plate, a second compression spring retained at its bottom end in the second compression spring housing in the push plate, the second compression spring extending through the second compression spring opening in the mechanical plate and retained at its top end in the second compression spring housing in the top plate; (m) a pad retained onto a bottom surface of the push plate; (n) a cloth removably retained under a bottom surface of said pad, the cloth retained by retaining members from at least the mechanical plate; and (o) wherein in an unactivated condition, the first tooth is retained in the first notch in the first ratchet collar, the second tooth is retained in the second notch in the second ratchet collar, the first and second compression springs are compressed and the cloth is removably retained, and when the first tooth is removed from the first notch and the second tooth is removed from the second notch, the first and second compression springs are converted to an un-compressed state and force the retaining members away from the cloth which falls away, the push plate travels away from the mechanical plate by a length of the shaft of the respective first and second mechanical fastening members.

Defined more broadly, the present invention is a mop comprising: (a) a longitudinal mop handle with a bottom end, a socket affixed to the bottom end of the mop handle, the socket including a multiplicity of grasping members extending away from the bottom end of the mop handle; (b) a ball including a retaining member affixed to the ball and extending away from an outer surface of the ball, the gasping members movably affixed to the outer surface of the ball to facilitate three-hundred sixty (360) degree rotation of the mop handle in one or more directions relative to the ball or relative to the top plate; (c) a top plate having a top portion with a top surface with a ball receiving member centrally located in the top portion of the top plate to receive and retain said ball retaining member with said ball centrally located on said upper surface of said top plate; (d) the top plate also including a first trigger activation member opening and a second trigger activation member opening which are spaced at equidistant opposite sides of the ball and each extending through a thickness of the top portion of the top plate, the top plate also includes a first ratchet collar cover located on the same side as and spaced apart from the first trigger activation member opening and a second ratchet collar cover located on the same side as and spaced apart from the second trigger activation member opening; (e) the top plate having a bottom surface which includes a first compression spring housing supporting a top of a first compression spring and a second compression spring housing supporting a top of a second compression spring; (f) a mechanical plate retained onto a bottom portion of the top plate by mating members on the bottom portion of the top plate affixed to mating members on an upper surface of the mechanical plate; (g) the mechanical plate including a first trigger member having a first "L"-shaped member with an upper portion extending through the first trigger activation member opening in the top with the upper portion of the first "L"-shaped member extending perpendicular to the top plate, a horizontal portion of the first "L"-shaped member extending to engaging a first transverse trigger member spring member and is further aligned with a first stop member on the top surface of the mechanical plate and at its distal end forms a first notch tooth, a second trigger member having a second "L"-shaped member with an upper portion extending through the second trigger activation member opening in the top plate and extending perpendicular to the top plate, a horizontal portion of the second "L"-shaped member extending to engage a second transverse trigger member spring member and is further aligned with a second stop member on the top surface of the mechanical plate and at its distal end forms a second notch tooth, the first notch tooth and the second notch tooth spaced apart and facing away from other; (h) the mechanical plate including a first ratchet collar opening adjacent said first notch tooth, a second ratchet collar opening adjacent said second notch tooth, a first compression spring opening and a second compression spring opening; (i) a push plate having a top surface including a first ratchet collar vertically aligned with the first ratchet collar cover of the top plate and spaced apart from the first operating trigger assembly of the first trigger member on the mechanical plate, the first ratchet collar having a sidewall with a first ratchet notch which receives the first notch tooth from the first trigger member, the first ratchet collar extends through aligned openings in the mechanical plate and the top plate and is received in the first ratchet collar cover on the top plate, affixed to the top surface of the push plate is a second ratchet collar vertically aligned with the second ratchet collar cover of the top plate and spaced apart from the second operating trigger assembly of the second trigger member on the mechanical plate, the second ratchet collar having a sidewall with a second ratchet notch which receives a second notch tooth from the second trigger member, the second ratchet collar extends through aligned openings in the mechanical plate and the top plate and is received in the second ratchet collar cover on the top plate; (j) affixed to the top surface of the push plate and spaced apart from the first ratchet collar is a first bottom compression spring housing retaining a bottom of the first compression spring extending through an aligned first spring opening in the mechanical plate and retained in the vertically aligned first top compression spring housing on the bottom surface of the top plate, affixed to the top surface of the push plate and spaced apart from the second ratchet collar is a second bottom compression spring housing retaining a bottom of the second compression spring extending through an aligned second spring opening in the mechanical plate and retained in the vertically aligned second top compression spring housing on the bottom surface of the top plate; (k) a first mechanical fastening member with a longitudinal shaft having a top end and a bottom end and extending from its bottom end affixed within the push plate and extends through the push plate, through an aligned opening in the mechanical plate and into an aligned opening within the first ratchet collar and having its top end retained within the first ratchet collar, a second mechanical fastening member with a longitudinal shaft having a top end and a bottom end and extending from its bottom end affixed within the push plate and extending through the push plate, through an aligned opening in the mechanical plate and into an aligned opening within the second ratchet collar and having its top end retained within the second ratchet collar; (l) a cloth removably retained under a bottom surface of said push plate, the cloth retained by retaining members from at least the mechanical plate; and (m) wherein in an inactivated condition, the first tooth is retained in the first notch in the first ratchet collar, the second tooth is retained in the second notch in the second ratchet collar, the first and second compression springs are compressed and the cloth is removably retained by the retaining members, and when the upper portion of the first "L"-shaped trigger activation member is pushed toward the ball and simultaneously the upper portion of the second "L"-shaped trigger activation member is pushed toward the ball, then the first tooth is removed from the first notch and the second tooth is removed from the second notch, the first and second compression springs are converted to an uncompressed state and force the retaining members away from the cloth which falls away, the push plate travels away from the mechanical plate by a length of the shaft of the respective first and second mechanical fastening members.

In another embodiment, there is described a mop comprising: (a) a longitudinal mop handle with a bottom end, a socket affixed to the bottom end of the mop handle, the socket including a multiplicity of grasping members extending away from the bottom end of the mop handle; (b) a ball including a retaining member affixed to the ball and extending away from an outer surface of the ball, the gasping members movably affixed to the outer surface of the ball to facilitate rotation of the mop handle in one or more directions relative to the ball; (c) a top plate having a top portion with a top surface with a ball receiving member centrally located in the top portion of the top plate to receive and retain said ball retaining member with said ball centrally located on said upper surface of said top plate; (d) a mechanical plate affixed onto said top plate, the mechanical plate including a first trigger member having a first "L"-shaped member with an upper portion extending through the top plate and a horizontal portion terminating in a first tooth, a second trigger member having a second "L"-shaped member with an upper portion extending through the top plate and a horizontal portion terminating in a second tooth, the respective upper portions of the first and second trigger member located on opposite sides of ball and spaced apart from the ball with openings in the top plate to enable the respective upper portions of the first and second trigger member to move toward each other the horizontal portions of the first and second trigger members facing away from each other; (e) a push plate having a top surface including a first ratchet collar vertically aligned with an opening in the mechanical plate adjacent said first tooth, a notch in the first ratchet collar into which the first tooth is inserted under spring pressure, a second ratchet collar vertically aligned with an opening in the mechanical plate adjacent said second tooth, a notch in the second ratchet collar into which the second tooth is inserted under spring pressure; (f) at least one compression spring retained at a top end in the top plate and at a bottom end in the push plate, the at least one compression spring extending through an aligned opening in the mechanical plate; (g) a first mechanical fastening member with a longitudinal shaft having a top end and a bottom end and extending from its bottom end affixed within the push plate and extends through the push plate, through an aligned opening in the mechanical plate and into an aligned opening within the first ratchet collar and having its top end retained within the first ratchet collar, a second mechanical fastening member with a longitudinal shaft having a top end and a bottom end and extending from its bottom end affixed within the push plate and extending through the push plate, through an aligned opening in the mechanical plate and into an aligned opening within the second ratchet collar and having its top end retained within the second ratchet collar; (h) a cloth removably retained under a bottom surface of said push plate, the cloth retained by retaining members from at least the mechanical plate; and (i) wherein in an unactivated condition, the first tooth is retained in the first notch in the first ratchet collar, the second tooth is retained in the second notch in the second ratchet collar, the at least one compression spring is compressed and the cloth is removably retained by the retaining members, and when the upper portion of the first "L"-shaped trigger activation member is pushed toward the ball and simultaneously the upper portion of the second "L"-shaped trigger activation member is pushed toward the ball, then the first tooth is removed from the first notch and the second tooth is removed from the second notch, the first and second compression springs are converted to an un-compressed state and force the retaining members away from the cloth which falls away, the push plate travels away from the mechanical plate by a length of the shaft of the respective first and second mechanical fastening members.

Further novel and non-obvious features of the present invention will become apparent from the following detailed description and discussion.

BRIEF DESCRIPTION OF THE DRAWINGS

Referring particularly to the drawings for the purpose of illustration only and not limitation, there is illustrated:

FIG. 4A1 is a top perspective view of the mechanical plate with the dual trigger mechanism in the unactivated condition;

FIG. 4A2 is a top side perspective view of the mechanical plate with the dual trigger mechanism in the activated condition;

FIG. 7-1 is an exploded view illustrating a bottom perspective view of the cover plate and a bottom perspective view of one embodiment of the mechanical plate;

FIG. 7-2 is an exploded perspective view illustrating a top perspective view of one embodiment of the push plate and a top perspective view of one embodiment of a pad;

FIG. 7-3 is a perspective view of a microfiber cloth;

FIG. 12-1 is an exploded view illustrating a bottom perspective view of the cover plate and a bottom perspective view of the mechanical plate;

FIG. 12-2 is an exploded perspective view illustrating a top perspective view of the push plate, a top perspective view of the pad used with the push plate, and a top perspective view of the non-woven cloth;

DETAILED DESCRIPTION OF THE EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention is a dual trigger mechanism to release a disposable microfiber cloth or non-woven cloth from a flat mop combined with a ball and socket assembly. The present invention includes one or more of the following components or features: (1) a socket affixed to a handle and a ball affixed to a top plate of the mop with the socket movably grasping the ball; (2) a top plate; (3) a mechanical plate with a dual trigger mechanism incorporated into the mechanical plate; (4) a push plate; and (5) a pad made of material such as foam or rubber below the push plate. In one variation, the invention retains a microfiber cloth or cloth made out of similar material. In an alternative variation, the invention retains a nonwoven cloth or cloth made out of similar material.

Figure 1:
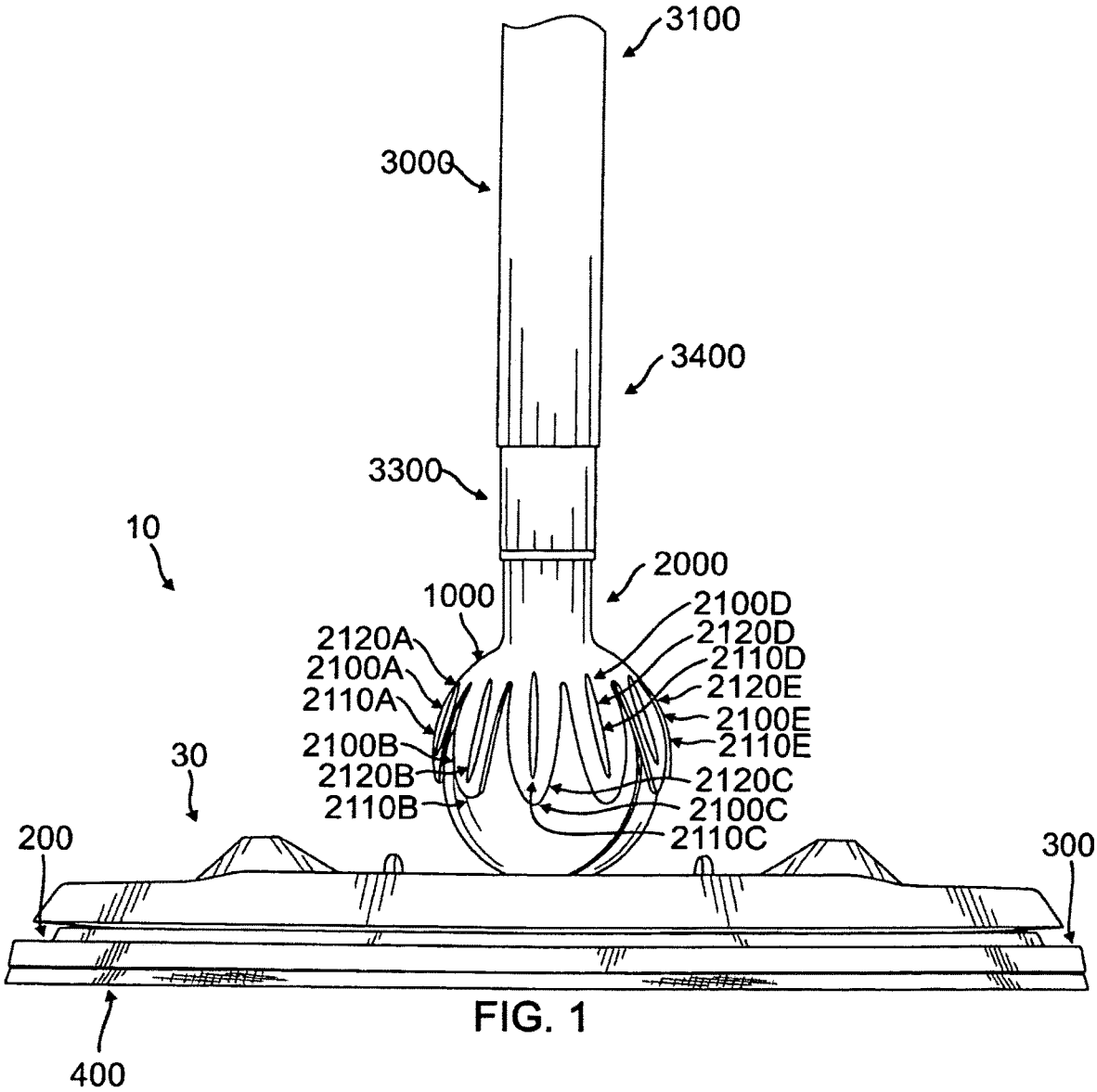
FIG. 1 is a side elevational view of a first embodiment of the present invention ball affixed to the top plate and a socket attached to the bottom of the mop handle with the socket grasping the ball and also illustrating the flat mop in an unactivated condition.
Figure 2:
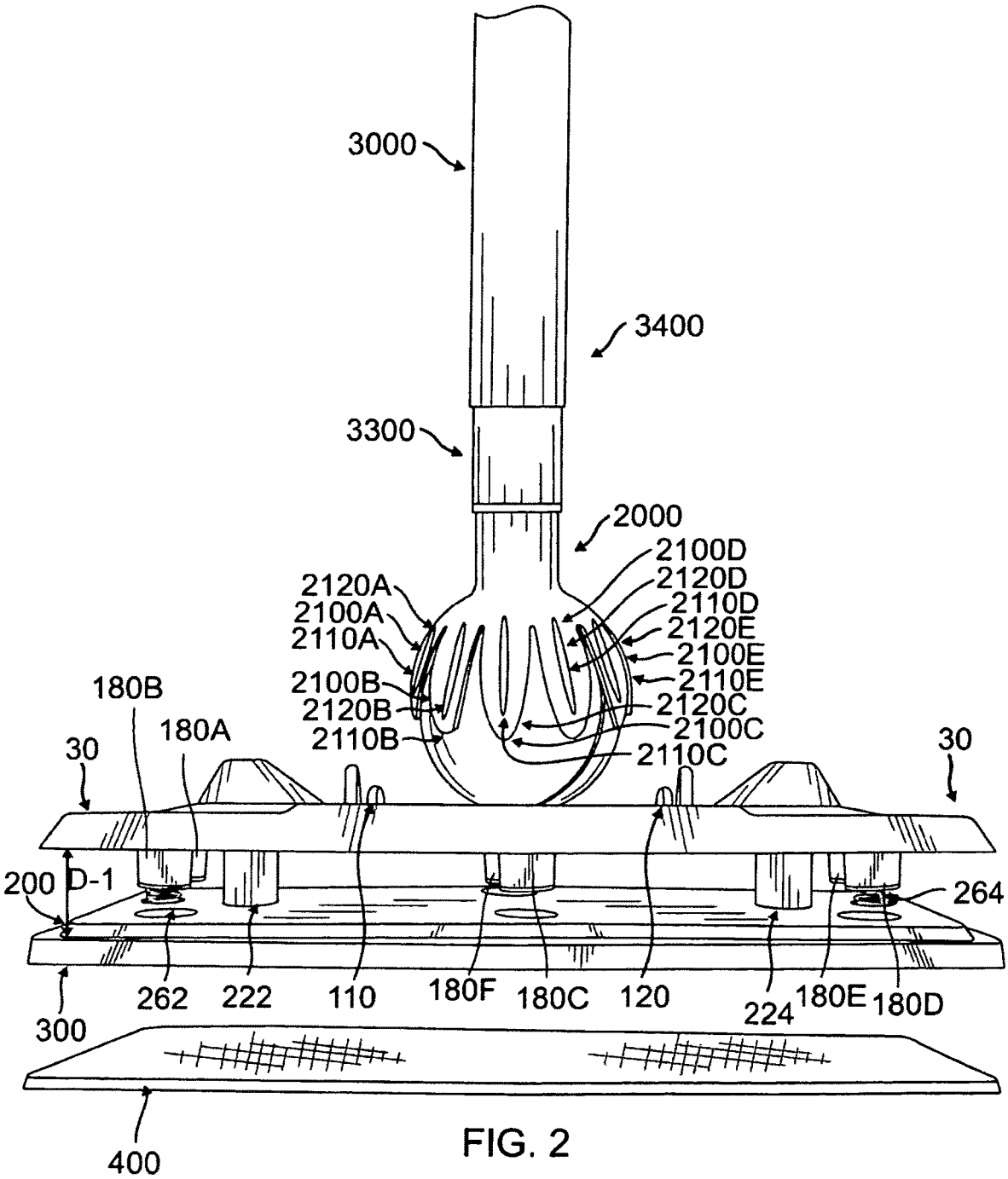
FIG. 2 is an exploded side perspective view of one embodiment of the present invention including a ball affixed to the top plate and a socket attached to the bottom of the mop handle with the socket grasping the ball and also illustrating the flat mop in an activated condition.
Figure 2A:
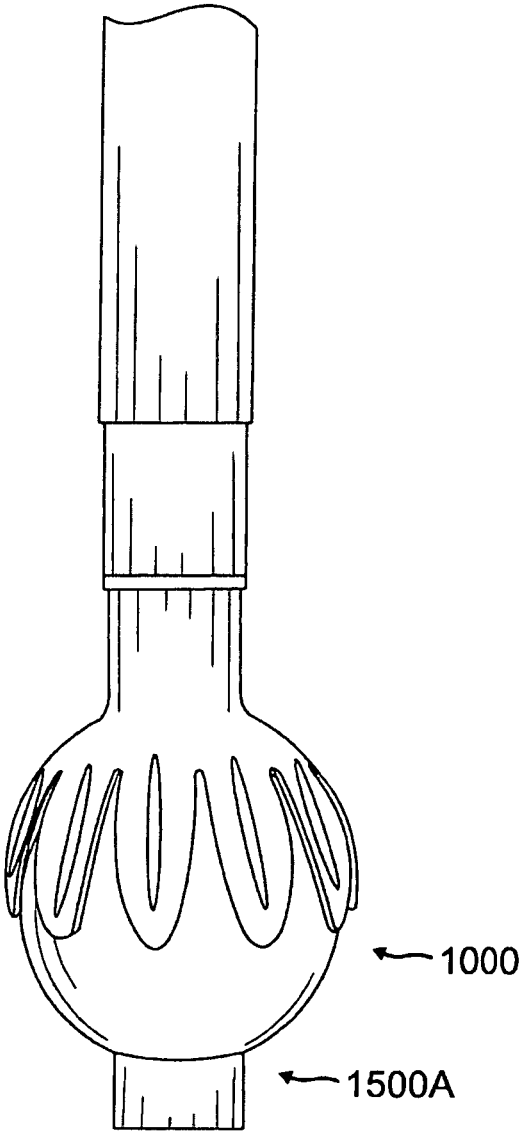
FIG. 2A is a side elevational view of the present invention mop handle with one embodiment of the present invention including a socket affixed to the bottom of the mop handle, the socket grasping/retaining the ball illustrating a bottom extension member such as a cylindrical stem on the ball.
Figure 2B:
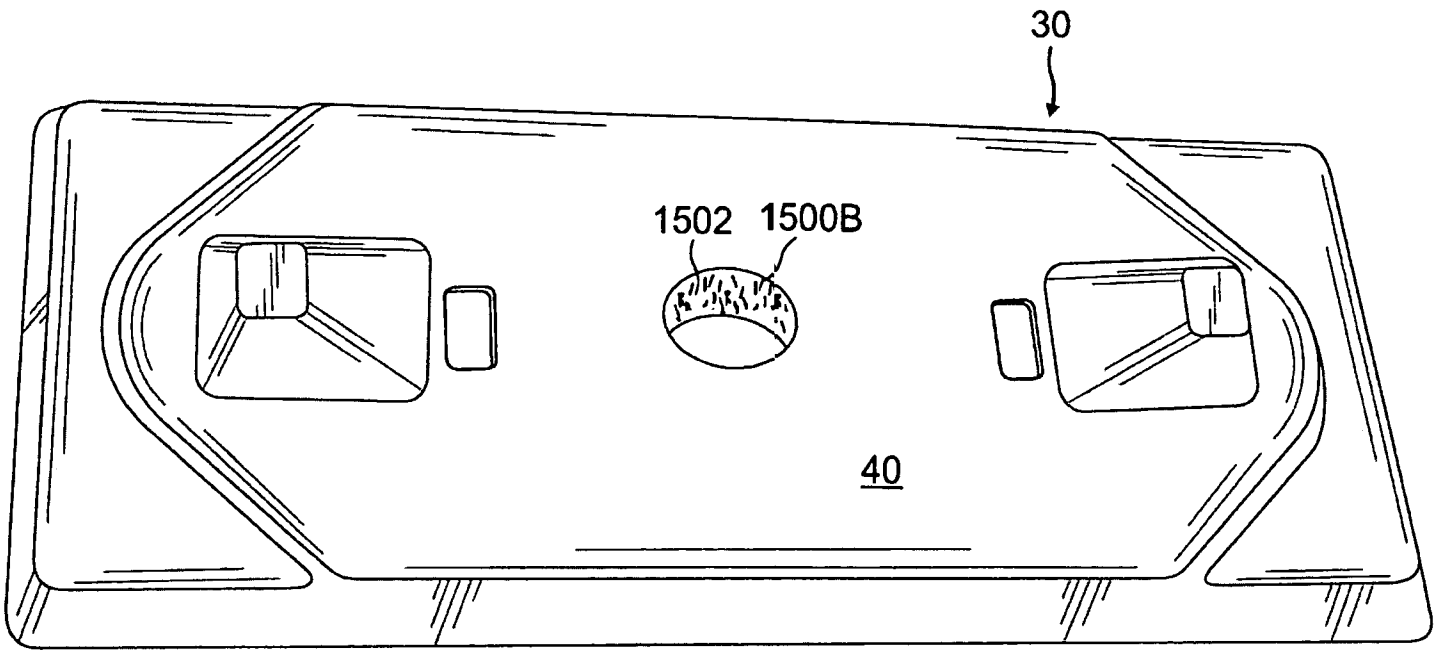
FIG. 2B is a top perspective view of the cover plate illustrating the receiving opening to receive the extension member of the ball.

Referring to FIG. 1, there is illustrated a side elevational view of a ball affixed to a top plate and a socket attached to a bottom of the mop handle with the socket grasping the ball and also illustrating the flat mop in the unactivated condition. Referring to FIG. 2, there is illustrated an exploded side perspective view of the present invention ball affixed to the top plate and a socket attached to the bottom of the mop handle with the socket grasping the ball also illustrating the flat mop in the activated condition. Referring to FIG. 2A, there is illustrated a side elevational view of the present invention mop handle with the present invention socket affixed to the bottom of the mop handle, the socket grasping/retaining the ball illustrating a bottom extension member such as a cylindrical stem on the ball. Referring to FIG. 2B, there is illustrated a top perspective view of the cover plate illustrating the receiving opening to receive the extension member of the ball.

Referring to FIG. 1, the present invention flat mop with ball retaining member and dual trigger is numbered 10. The present invention flat mop with ball retaining member and dual trigger 10 is generally comprised of top cover 30, mechanical plate 100 (which is retained within the top cover and therefore not visible in FIG. 1, but which will be described later on in this application), a push plate 200 (which is only partially visible in FIG. 1 but which will be described in greater detail later in his application), a rubber or foam pad 300 and a microfiber cloth 400 retained against the foam or rubber pad 300 by retaining members from the mechanical plate 100 as will be described. Also illustrated in the handle 3000, and retaining ball 1000.

Referring to FIG. 1, there is the present invention flat mop with ball retaining member and dual trigger 10 in the closed position. Positioned on the top surface and affixed to top cover 30 is mop positioning ball 1000 (also referred to generally as "ball"). A socket 2000 is affixed to the bottom 3400 of mop handle 3000 by a joining member 3300. The mop positioning ball 1000 (also called positioning ball, or ball in this application) is at least partially surrounded and grasped by one or more of socket grasping members, of which five—2100A, 2100B, 2100C, 2100D and 2100E—are illustrated in FIG. 1. Three additional grasping member are on an opposite side of the mop positioning ball 1000 and are respectively opposite to socket grasping members 2100B, 2100C and 2100D. While eight socket grasping members are discussed, it is appreciated that any multiplicity of socket grasping members is within the spirit and scope of the present invention.

Preferably, each respective socket grasping member is equally spaced apart from the next. Each illustrated grasping member has a respective longitudinal center 2110A, 2110B, 2110C, 2110D, 2110E.

When viewed from its exterior, each illustrated respective grasping member 2100A, 2100B, 2100C, 2100D, 2100E, has an exterior central rib 2120A, 2120B, 2120C, 2120D, 2120E. Socket 2000 is affixed to the bottom 3400 of handle 3000 by an affixing member 3300 which in the present invention is a rivet but could be affixed by other similar affixing means such as a bolt or screw. The handle 3000 has an elongated body 3100 terminating in a top cap (not illustrated). The handle 3000 is grasped by a user's hand around a portion of the elongated body 3100 or at or adjacent the top of the handle.

Referring to FIG. 2, there is illustrated a front elevational view of the flat mop with mop positioning ball retaining member and dual trigger 10 in an activated position illustrating a portion of the first ratchet collar 222, a portion of a second ratchet collar 224, a portion of a first compression spring 262 and a portion of a second compression spring 264. Also illustrated is a portion of six retaining member posts 180A, 180B, 180C, 180D, 180E and 18F. When activated by dual triggers 110 and 120 simultaneously pressed together, this allows flat mop with ball retaining member and dual trigger 10 to transition from the closed position illustrated in FIG. 1 to the open position in FIG. 2. As will be described, the push plate 200 is forced away from the mechanical plate by a distance "D-1", releasing the retention force on the microfiber cloth 400 enabling the microfiber cloth 400 to fall away. The push plate 200 and pad 300 only travel by the distance D-1 due to retention pins, as will be described.

Further referring to FIGS. 2, 2A and 2B, 2B, and 3A, top cover 30 is stationary with respect to the ball 1000. It has a generally flat upper top surface 40 with retaining ball 1000 located at a center of top cover 30. Ball 1000 has a round exterior surface 1200. Ball 1000 is affixed to top upper surface 40 by means of a bottom extension member 1500A such as a smooth post inserted into receiving opening 1500B and retained therein by an adhesive 1502 such as glue, a press snap fit and glue or an engaging member 1500D (see FIG. 3B) within opening 1500B engaging and restraining extension member 1500A. Ball 1000 is stationary with respect to top cover 30 and receives socket 2000 through grasping members 2100A, 2100B, 2100C, 2100D, 2100E, 2100F, 2100G, and 2100H. As previously described, the socket 2000 is affixed to the bottom 3400 of the mop handle 3000. When the grasping members 2100A, 2100B, 2100C, 2100D, 2100E, 2100F, 2100G, and 2100H of socket 2000 engage and movably encircle ball 1000, the mop handle 3000 is able to rotate three-hundred sixty (360) degrees in one or more directions. Therefore, a user grasping the elongated body 3100 of mop handle 3000 can push and pull the mop back and forth in any direction when cleaning a flat surface such as a floor.

Figure 3A:
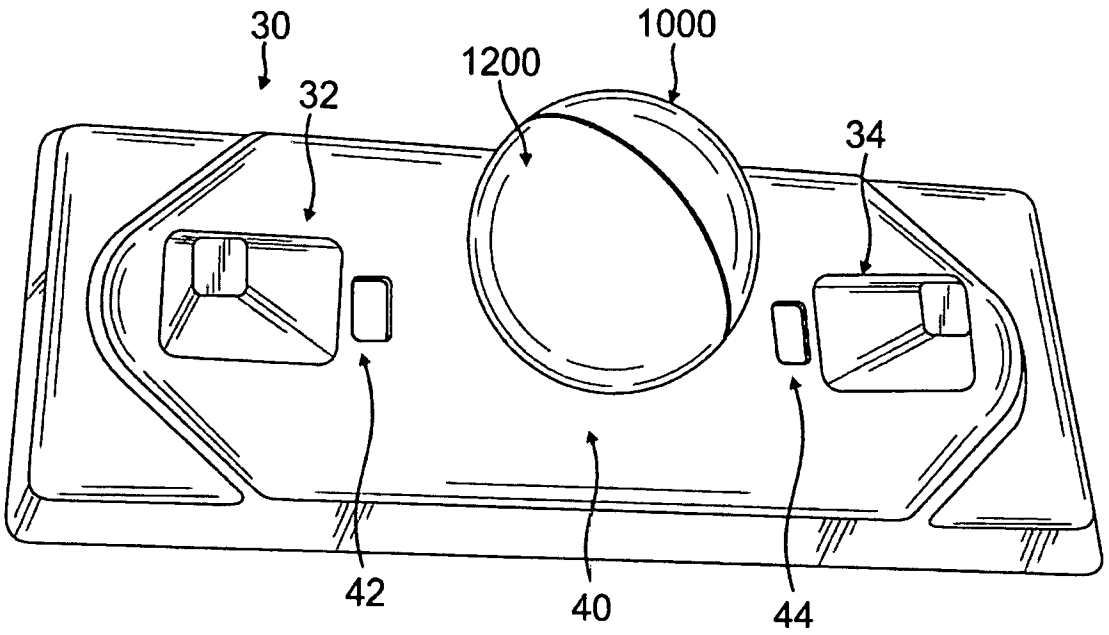
FIG. 3A is a top perspective view of the top plate of the present invention.
Figure 3B:
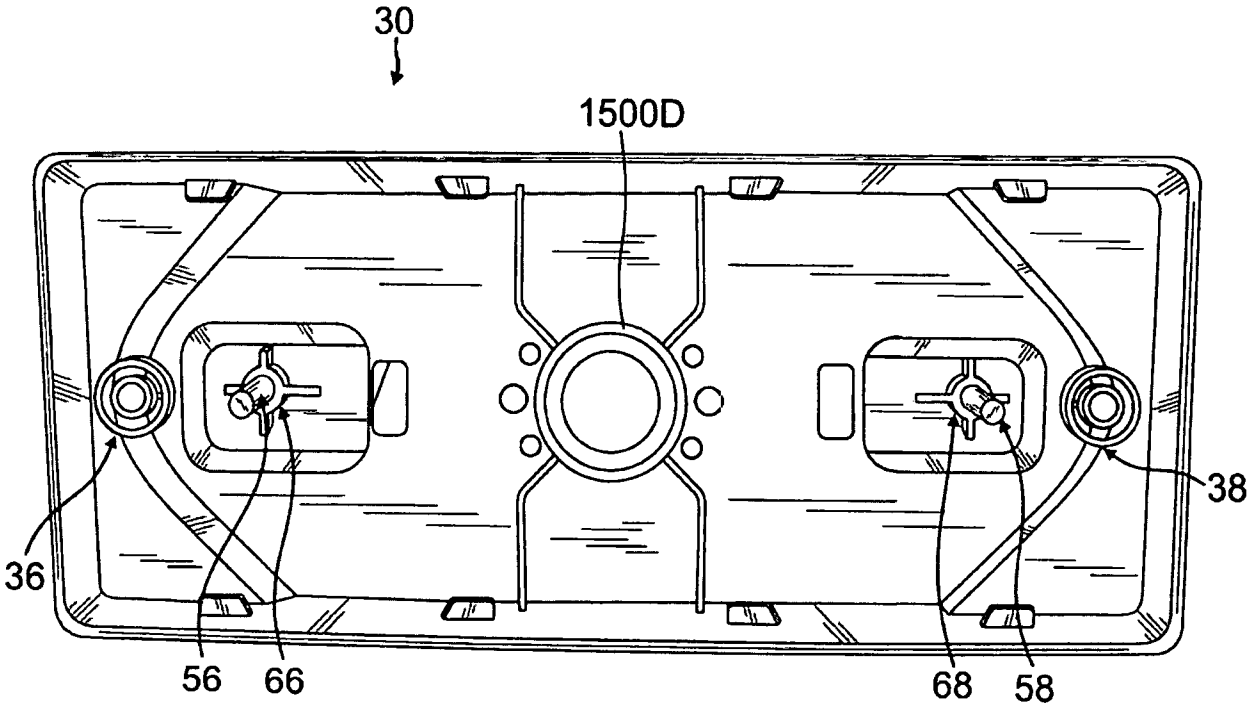
FIG. 3B is a bottom perspective view of the top plate of the present invention.

Referring to FIGS. 3A and 3B, there is illustrated the top and bottom views respectively of top cover 30. Referring to FIG. 3A, there is illustrated top view of top cover 30 illustrating two ratchet collar covers 32 and 34. Located on top upper surface 40 of top cover 30 and between ball 1000 and ratchet collar covers 32 and 34 are trigger activation member openings 42 and 44 that provide an opening for dual trigger activation members 110 and 120 to pass through and be accessible for a user. The bottom view of top cover 30 illustrated by FIG. 3B shows a top cover bottom having a first top compression spring housing 36 and a second top compression spring housing 38. First top compression spring housing 36 and second top compression spring housing 38 assist in retaining first compression spring 262 and second compression 264 in a vertical position while the present invention converts from the closed position or useable position shown in FIG. 1 to the open position or cloth changing position shown in FIG. 2.

Figure 5A:
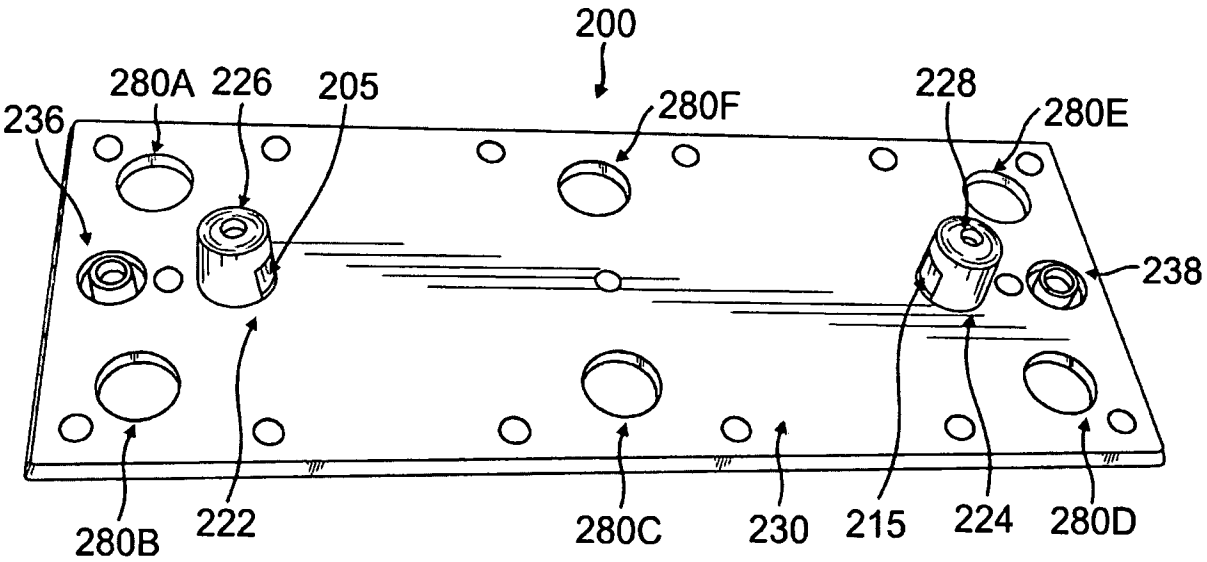
FIG. 5A is a top perspective view of one embodiment of the push plate.

Further referring to FIGS. 1, 2, and 3B, there is illustrated a first post or first retaining pin 56 and a second post or second retaining pin 58 that respectively fit into a first ratchet hole 226 and a second ratchet hole 228 (illustrated in FIG. 5A). FIG. 3B also illustrates first post 56 and second post 58 which provide a slidable path by which the push plate 200 and the pad 300 (which are press fit together) slide downwardly when the present invention flat mop with ball retaining member and dual trigger 10 transitions from the closed position illustrated in FIG. 1 to the open position illustrated in FIG. 2. Left post connector 66 and right post connector 68 retain top cover 30 and mechanical plate 100 respectively to first post 56 and second post 58 when separate from upper push plate 200 and lower push plate 300. The length of first post 56 and second post 58 coupled with the location of left post connector 66 and right post connector 68 provide the length of travel that upper push plate 200 and lower push plate 300 can slide. Further, these components working in conjunction with left fastening pin 274 and right fastening pin 284 (illustrated in FIG. 5B) allow upper push plate 200 and pad 300 to expand a distance approximately equal to the length of first post 56 and second post 58, but not beyond this length.

Referring to FIGS. 3A and 3B, top cover 30 includes dual trigger activation member openings 42 and 44 with an opening which enables a first trigger activation member 110 to extend through first trigger activation member opening 42 and further extend substantially perpendicular to the top upper surface 40 of top cover 30 and located spaced apart from ball 1000. A second trigger activation member opening 44 enables a second activation member 120 to extend through second trigger activation member opening 44 and further extend substantially perpendicular to top upper surface 40 of top cover 30 and located spaced apart from said ball 1000. First or left trigger opening 42 and second or right trigger opening 44 are parallel to each other and are located on opposite locations relative to ball 1000.

Referring to FIGS. 4A1 and 4A2, there is illustrated two top views of mechanical plate 100. FIG. 4A1 illustrates the top view of mechanical plate 100 illustrating a first or left trigger assembly 102 having a left central shaft 104 with left central shaft 104 having a left upper wing 107 and a left lower wing 108 that extend generally perpendicular and away from left central shaft 104. Left central shaft 104 is also slidably affixed to top mechanical surface 130 of mechanical plate 100 by left trigger assembly housing 106. Left central shaft 104 and left upper wing 107 and a left lower wing 108 are formed from a flexible material such as spring plastic to allow left upper wing 107 and a left lower wing 108 to bend and store potential energy when left trigger 110 is pressed inwardly towards right trigger 120.

Similarly, FIG. 4A1 also illustrates the top view of mechanical plate 100 illustrating a second or right trigger assembly 112 having a right central shaft 114 with right central shaft 114 having a right upper wing 117 and a right lower wing 118 that extend generally perpendicular and away from right central shaft 114. Right central shaft 114 is also slidably affixed to top mechanical surface 130 of mechanical plate 100 by right trigger assembly housing 116. Right central shaft 114 and right upper wing 117 and a right lower wing 118 are formed from a flexible material such as spring plastic to allow right upper wing 117 and a right lower wing 118 to bend and store potential energy when right trigger 120 is pressed inwardly towards left trigger 110.

In operation, when left trigger 110 and right trigger 120 (which have also been referred to as first trigger activation member 110 and second trigger activation member 120) are pressed inward together, shaft left end 105 and shaft right end 115 move inward and out of respective ratchet collar notches 205 and 215, left ratchet collar 222 and right ratchet collar 224 thereby exposing entirely left mechanical plate ratchet hole 148 and right mechanical plate ratchet hole 158. When left mechanical plate ratchet hole 148 and right mechanical plate ratchet hole 158 are entirely exposed and not covered by any portion of shaft left end 105 and shaft right end 115 as illustrated in FIG. 4A2, left compression spring 262 and right compression spring 264 are allowed to expand from their respective compressed states to force upper push plate 200 and lower push plate 300 to expand to a position approximately 2 inches below top cover 30. In other embodiments, other distances are contemplated. This is best illustrated by FIG. 2 where present invention flat mop with ball retaining member and dual trigger 10 are illustrated in the open position.

Simultaneously occurring with the inward movement of left trigger assembly 102 and right trigger assembly 104 when left trigger 110 and right trigger 120 are pressed inwardly is the bending of left upper wing 107, left lower wing 108, right upper wing 117, and right lower wing 118. This bending is caused by the inward force acting upon left trigger assembly 102 and right trigger assembly 104 which causes all four wing walls to bend around left stoppers 142A, 142B, 142C, 142D and right stoppers 152A, 152B, 152C, and 152D. All four wings transition from a convex resting position when dual triggers are at a resting outer position (illustrated in FIG. 4A1) to an inward concave position (illustrated in FIG. 4A2) when left trigger 110 and right trigger 120 are pressed inwardly. When left trigger 110 and right trigger 120 are released, all four wings exercise a spring force to return left trigger assembly 102 and right trigger assembly 104 to their initial resting outer position (illustrated in FIG. 4A1).

Figure 4B:
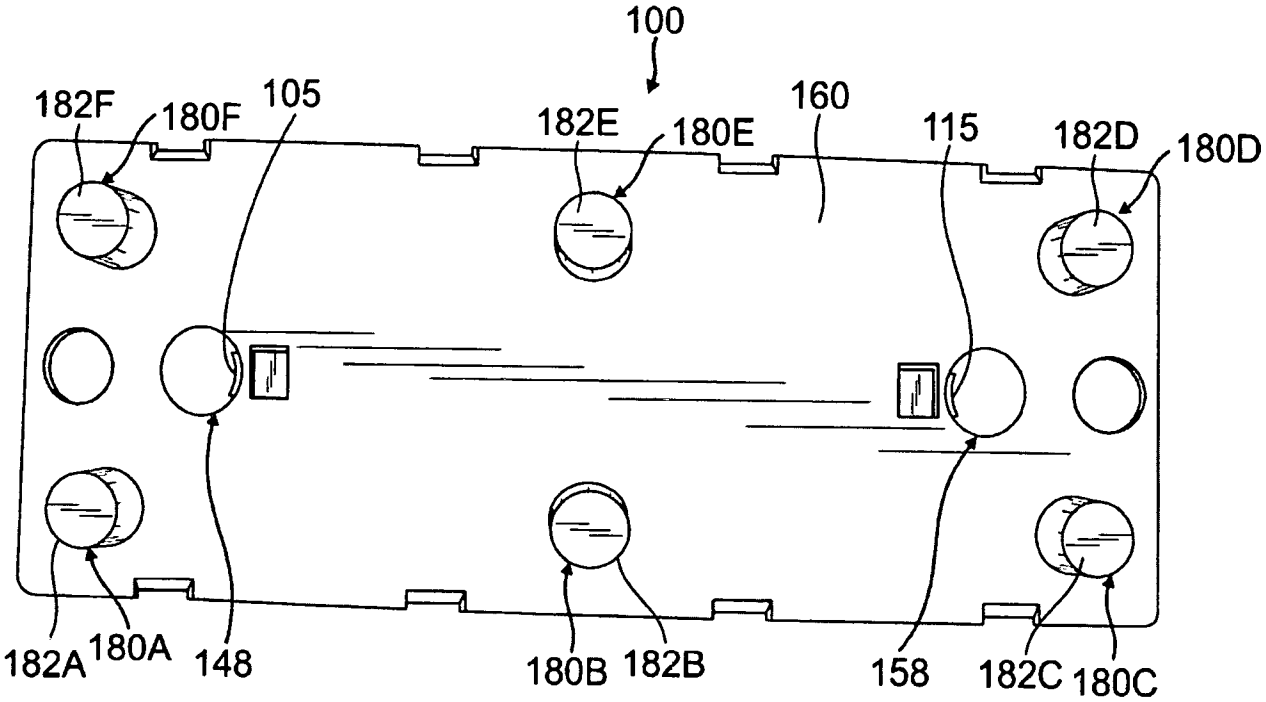
FIG. 4B is a bottom perspective view of a first alternative embodiment of the mechanical plate.

Referring to FIGS. 4A2 and 4B, there is illustrated a top view of mechanical plate 100 and a bottom view of mechanical plate 100 respectively. FIG. 4A2 illustrates a multiplicity of cloth retaining members 180A, 180B, 180C, 180D, 180E and 180F to enable a cloth to be retained by hook fasteners. Each respective distal end of cloth retaining members 180A, 180B, 180C, 180D, 180E and 180F have cloth retaining ends 182A, 182B, 182C, 182D, 182E and 182F that is made of either a hook material or a fastener material, also known as hook or loop fasteners and pile fasteners.

Referring to FIGS. 4B, 5A, 5B, 6A, and 6B, cloth retaining members 180A, 180B, 180C, 180D, 180E and 180F fit through push plate openings 280A, 280B, 280C, 280D, 280E and 280F and pad openings 380A, 380B, 380C, 380D, 380E and 380F to allow cloth retaining members 180A, 180B, 180C, 180D, 180E and 180F to be exposed at the bottom of the first embodiment flat mop with ball retaining member and dual trigger 10. Collectively cloth retaining ends 182A, 182B, 182C, 182D, 182E and 182F which are comprised of either a hook or fastener material will retain a micro fiber cloth 400 (not illustrated) that also has either hook or fastener material affixed to the micro fiber cloth.

Figures 1, 7:
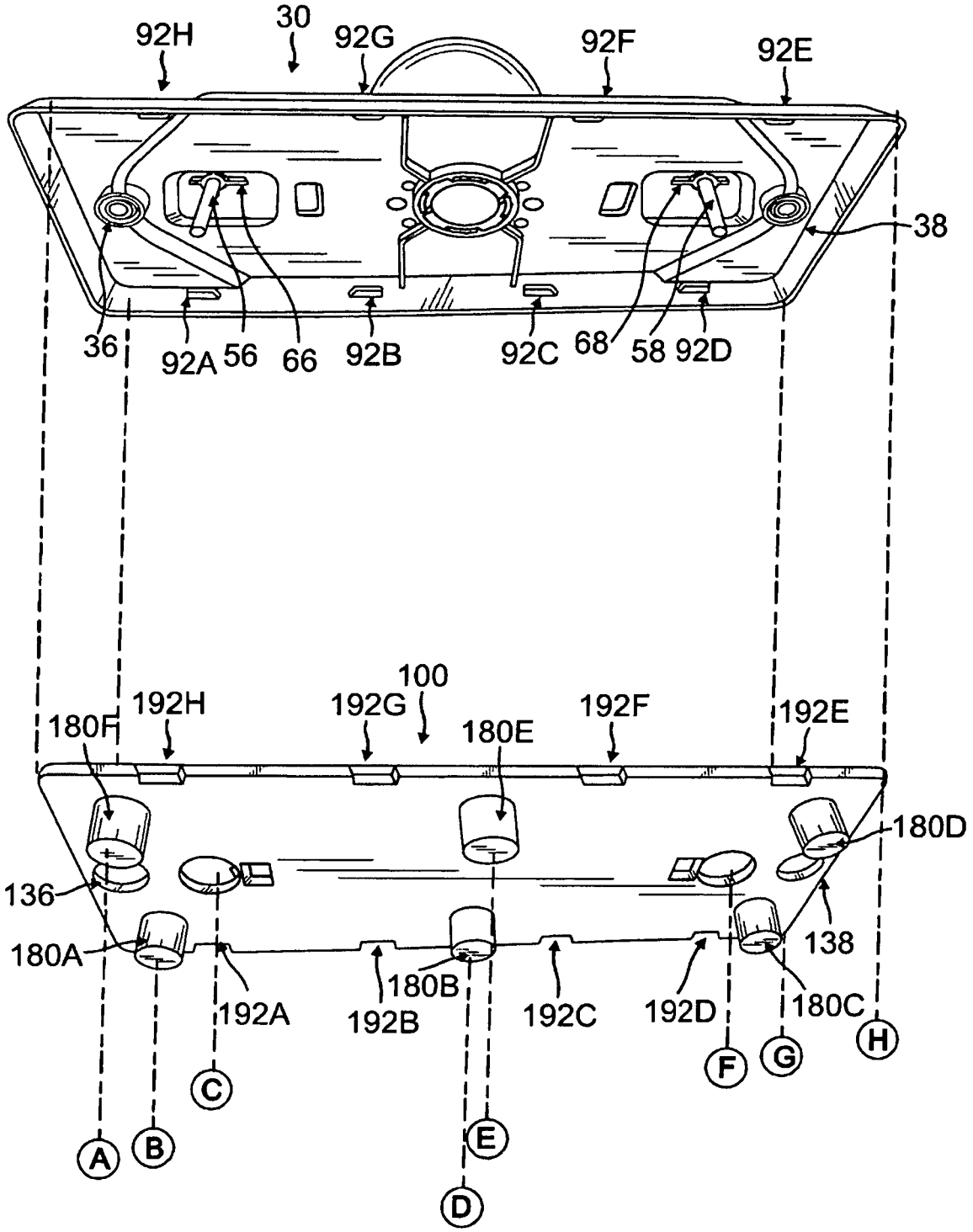
Figures 2, 7:
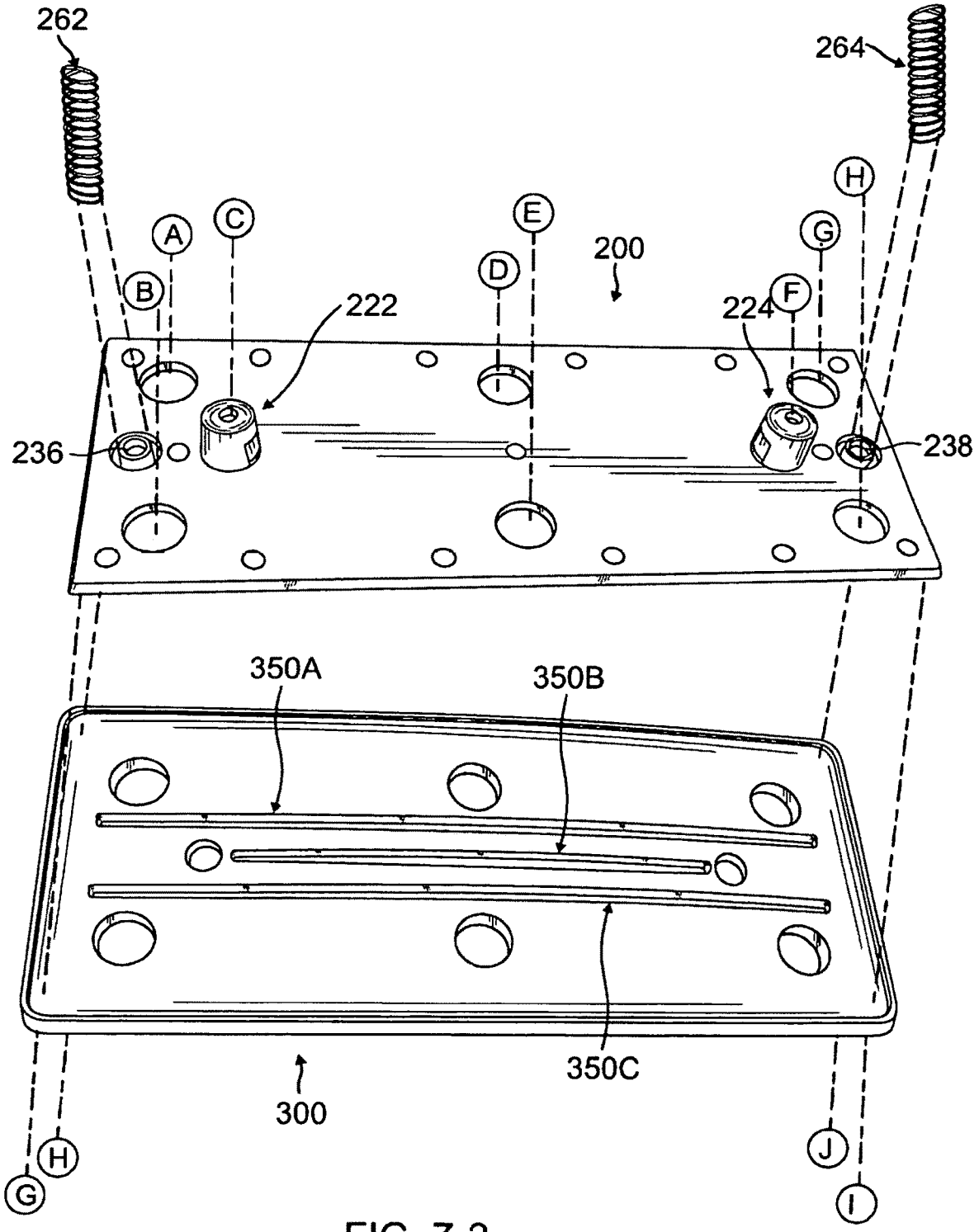
Figures 3, 7:
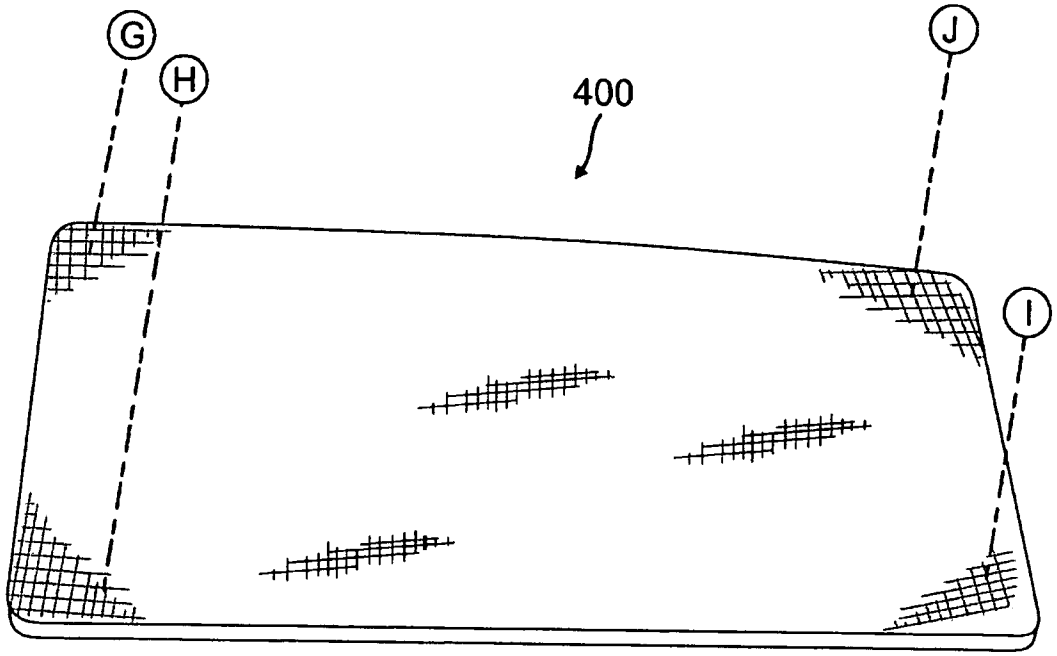

Referring to FIGS. 5A and 7-2, there is illustrated a first upper press plate compression spring housing 236 and a second upper press plate compression spring housing 238. Compression springs 262 and 264 are retained respectively within first upper press plate compression spring housing 236 and second upper press plate compression spring housing 238 and first top compression spring housing 36 and second top compression spring housing 38.

Figure 5B:
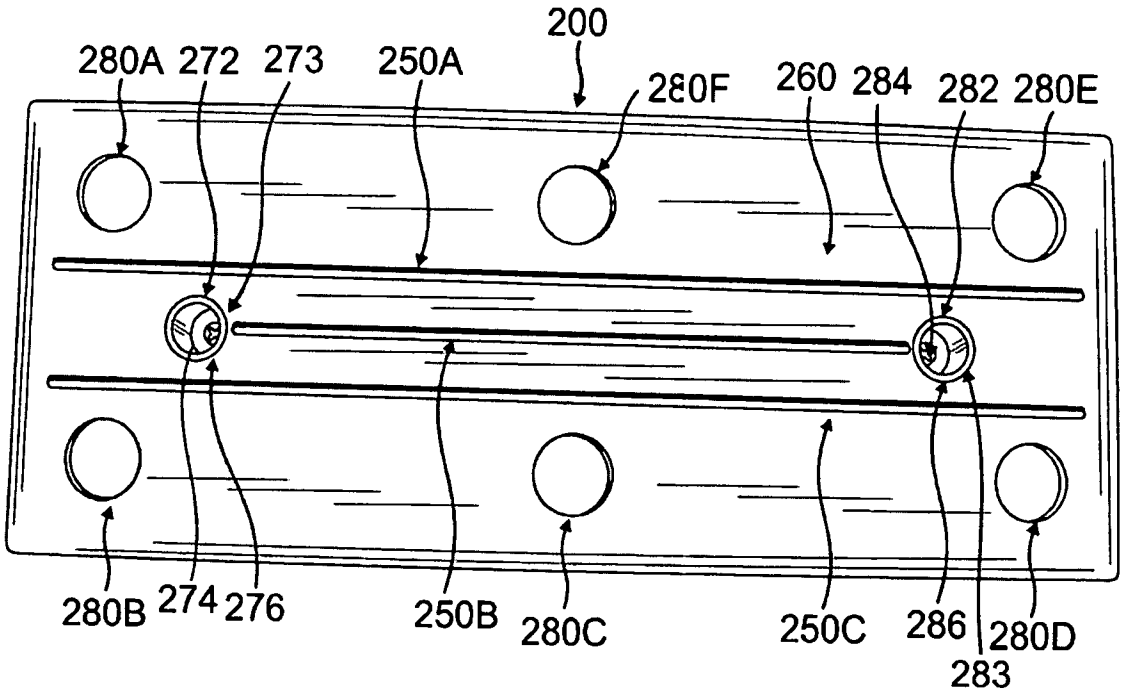
FIG. 5B is a bottom perspective view of one embodiment of the push plate of FIG. 5A.

Referring to FIG. 5B, there is a bottom view of push plate 200, illustrating push plate openings 280A, 280B, 280C, 280D, 280E and 280F. Also illustrated is a first or left fasting pin opening 272 and a second or right fastening pin opening 274 that extend upward from upper push plate bottom surface 260 and respectively through cylindrical chambers 273 and 275 to smaller circular openings second left fasting pin opening 276 and second right fasting pin opening 286. Left fastening pin 274 and a right fastening pin 284 have larger diameters than second left fasting pin opening 276 and second right fasting pin opening 286 to retain upper push plate 200 from becoming detached from first post 56 and second post 58. Therefore, upper push plate 200 will extend to a maximum distance equal to the lengths of first post 56 and second post 58 and will remain affixed along first post 56 and second post 58 during the opening and closing of the present invention flat mop with ball retaining member and dual trigger 10.

Figure 6A:
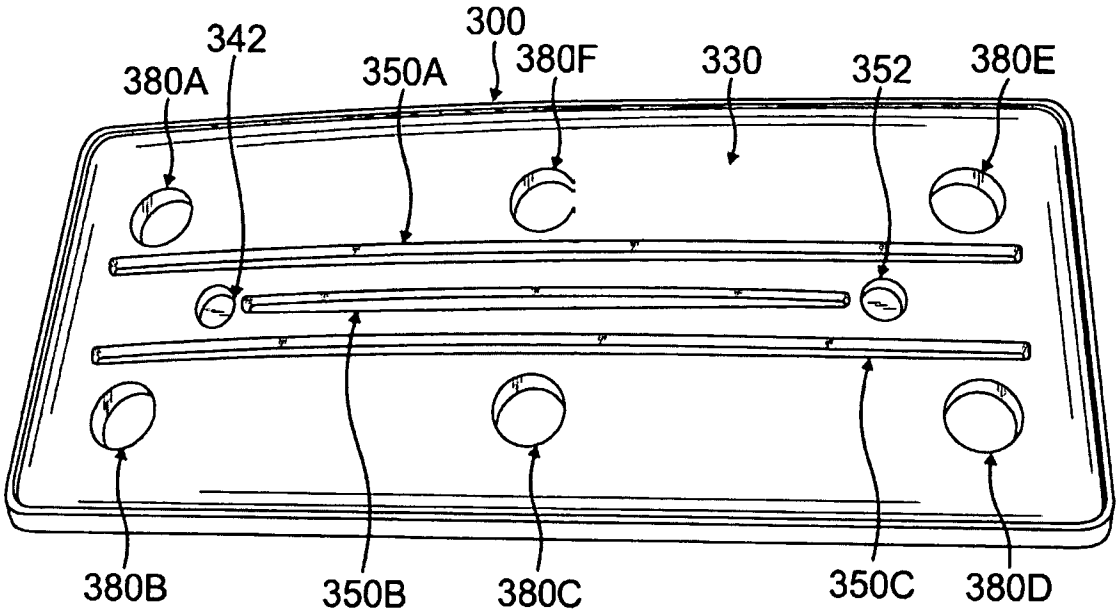
FIG. 6A is a top perspective view of one embodiment of a rubber or foam pad below the push plate.
Figure 6B:
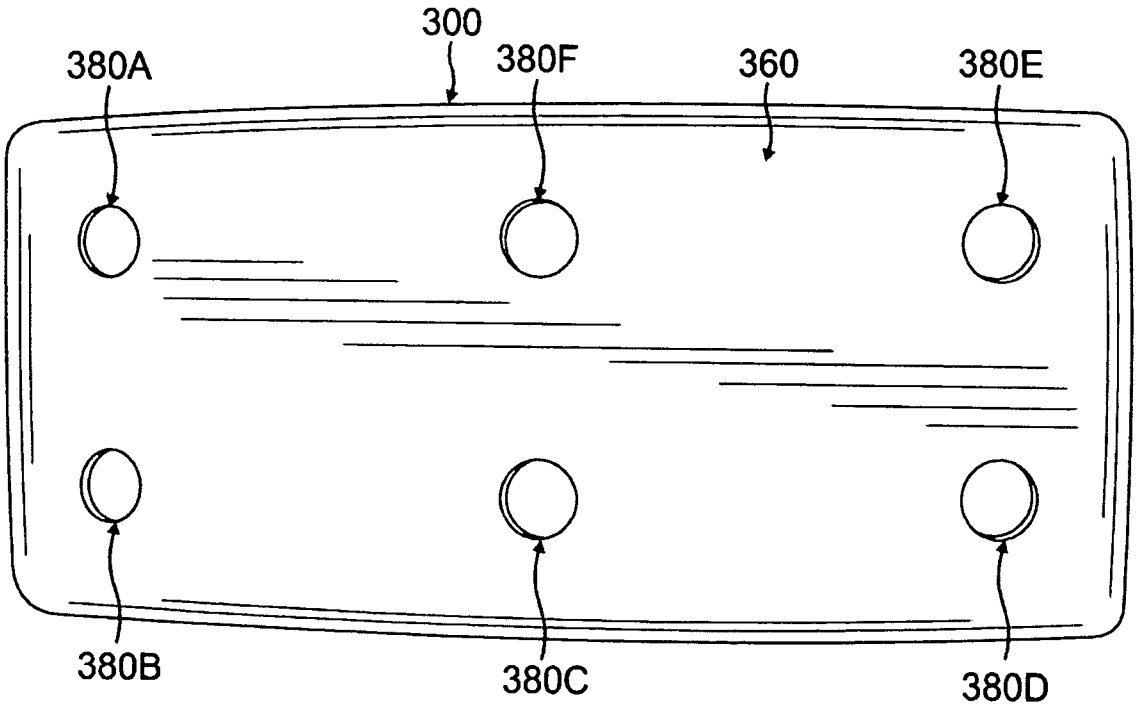
FIG. 6B is bottom perspective view of one embodiment of the rubber or foam pad below the push plate of FIG. 6A.

Referring to FIGS. 5B, 6A, 6B, and 7-2, there is illustrated pad plate 300 having a pad upper surface 330 and a pad bottom surface 360. Pad upper surface 330 has female slots 350A, 350B, and 350C (FIG. 6) that receive male slots 250A, 250B, and 250C (FIG. 5B) to press fit retain pad 300 to push plate 200. Alternatively, the pad 300 is retained to the push plate 200 by adhesive. Also illustrated in FIG. 6A are pad openings 380A, 380B, 380C, 380D, 380E and 380F to allow cloth retaining members 180A, 180B, 180C, 180D, 180E and 180F to be exposed at the bottom of the first embodiment flat mop with ball retaining member and dual trigger 10. Pad upper surface 330 also respectively has a left opening 342 and a right opening 352 that respectively form the bottom surface that left fastening pin 274 and a right fastening pin 284 abut.

Referring to FIGS. 7-1, 7-2 and 7-3, there is illustrated an exploded view of the present invention flat mop with ball retaining member and dual trigger 10 illustrating top cover 30, mechanical plate 100, push plate 200, pad push plate 300 and microfiber cloth 400. Top cover 30 has eight male connectors 92A, 92B, 92C, 92D, 92E, 92F, 92G, and 92H that connect respectively to eight female connectors 192A, 192B, 192C, 192D, 192E, 192F, 192G, and 192H located on mechanical plate 100 to removably affix top cover 30 to mechanical plate 100. Therefore, in operation when the present invention flat mop with ball retaining member and dual trigger 10 transitions from the closed position to the open position, top cover 30 and mechanical plate 100 remain affixed together.

Similarly, push plate 200 is press fit retained or adhesively retained as previously explained to pad 300. Pad 300 and push plate 200 move together as one piece when present invention flat mop with ball retaining member and dual trigger 10 transitions from the closed position (illustrated in FIG. 1) to the open position (illustrated in FIG. 2).

FIG. 3B shows first top compression spring housing 36, and second top compression spring housing 38, and FIG. 7-2 shows first lower spring housing 236 and second lower spring housing 238. First top compression spring housing 36, second top compression spring housing 38, first lower spring housing 236 and second lower spring housing 238 respectively retain first compression spring 262 and second compression spring 264 when the present invention flat mop with ball retaining member and dual trigger 10 transitions from the closed position illustrated in FIG. 1 to the open position illustrated in FIG. 2.

First post 56 which is also fastening pin 274 and second post 58 which is also fastening pin 280 provide the posts that top cover 30 slides upward along when top cover 30 opens from the closed position. Left post connector 66 and right post connector 68 provide the means by which top cover 30 is retained along first post 56 and second post 58. First post 56 and second post 58 respectively fit into a first ratchet hole 226 and a second ratchet hole 228 (illustrated in FIG. 5A).

Figure 8A:
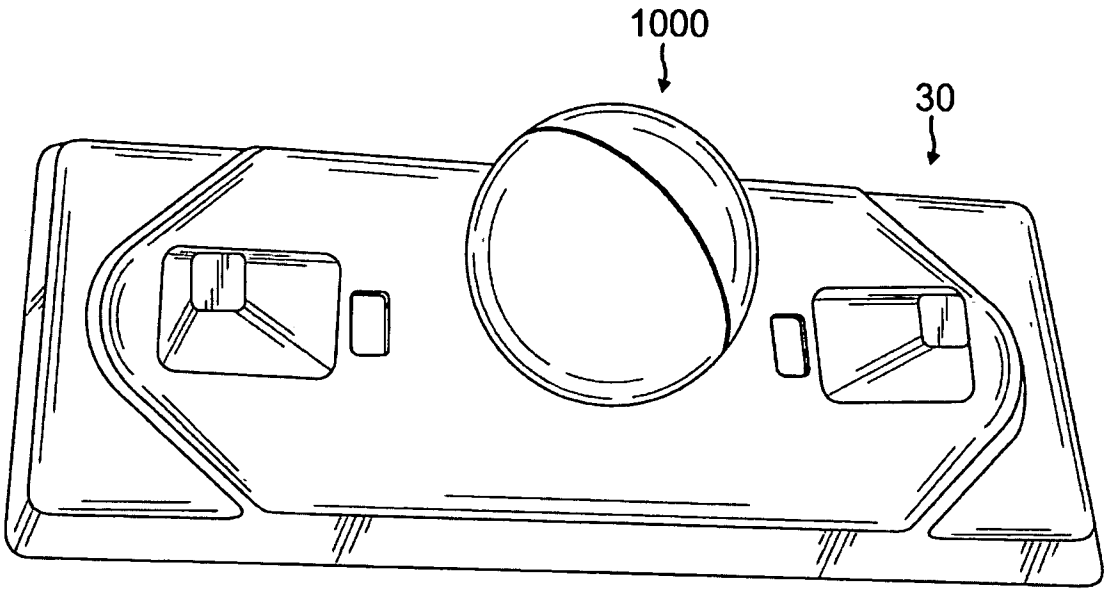
FIG. 8A is a top perspective view of the top plate of the present invention, illustrated for discussion of another embodiment of the present invention.
Figure 8B:
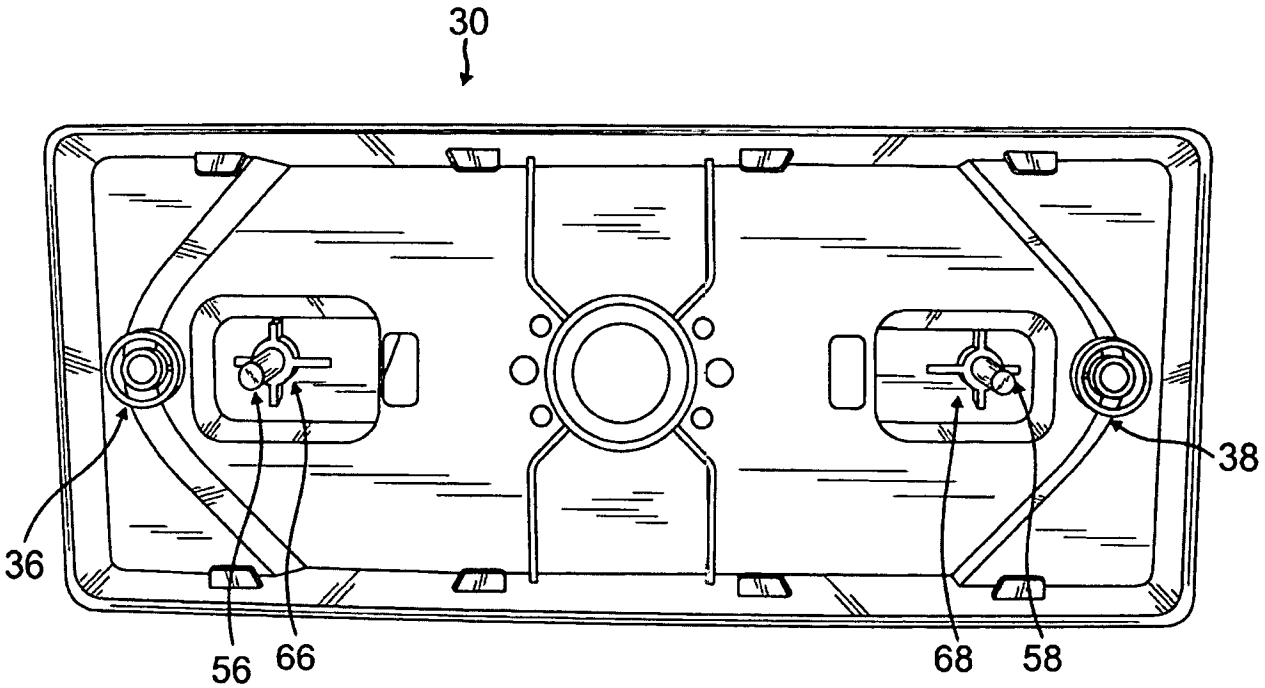
FIG. 8B is a bottom view of the top plate of the present invention, illustrated for discussion of the embodiment of FIG. 8A.

Referring to FIGS. 8A and 8B, there is illustrated a top and bottom view of another embodiment of the present invention flat mop with ball retaining member and dual trigger 10. The difference between one embodiment (illustrated in FIGS. 3A to 7-1 and 7-2) and another embodiment (illustrated in FIGS. 8A to 12) are the methods by which the cloth is retained to the present invention flat mop with ball retaining member and dual trigger 10. In one embodiment, microfiber cloth 400 is retained to the present invention by use of hook fasteners. In the second embodiment, the non-woven cloth 1400 is retained to the present invention by means of female and male mating members or teeth that retain non-woven cloth 1400 until dual triggers 110 and 120 (which function collectively, with top cover, ratchet collars, posts, compression springs, and fastening pins as previously described and identical to the first embodiment) are pressed simultaneously together to allow the flat mop with ball retaining member and dual trigger 10 to transition from the closed position illustrated in FIG. 1 to the open position illustrated in FIG. 2. The six cloth retaining members and corresponding holes in the first described embodiment are replaced by female mating members on the bottom surface of the mechanical plate and male mating members on the upper surface of the upper push plate in the second described embodiment.

Figure 9A:
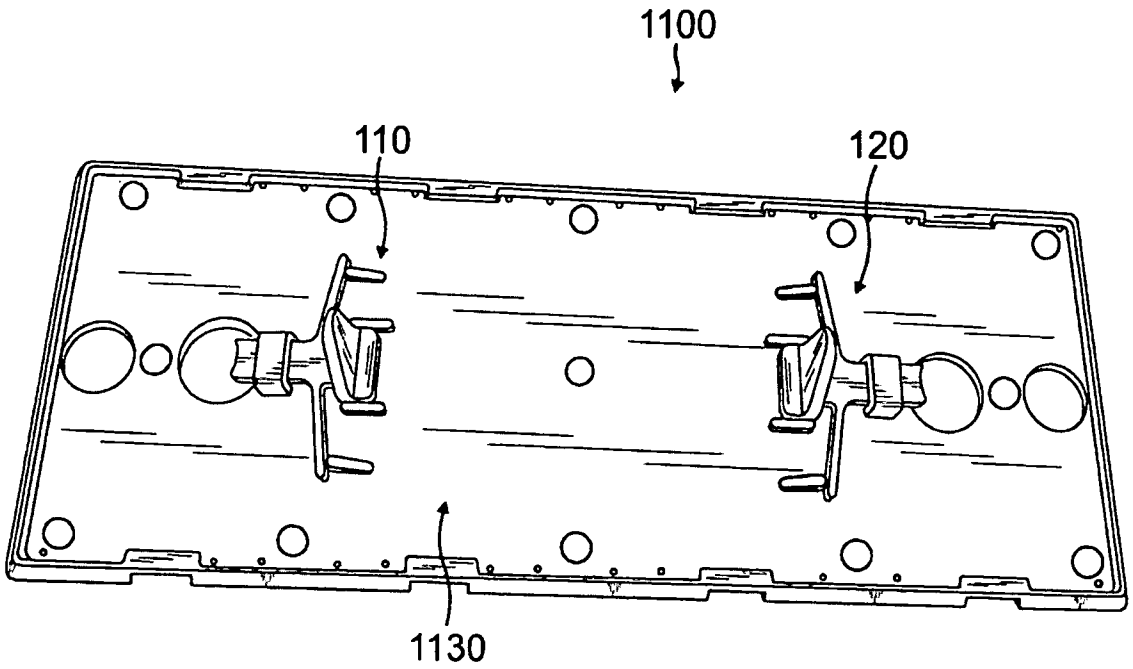
FIG. 9A is a top perspective view of one embodiment of the mechanical plate in the unactivated condition.
Figure 9B:
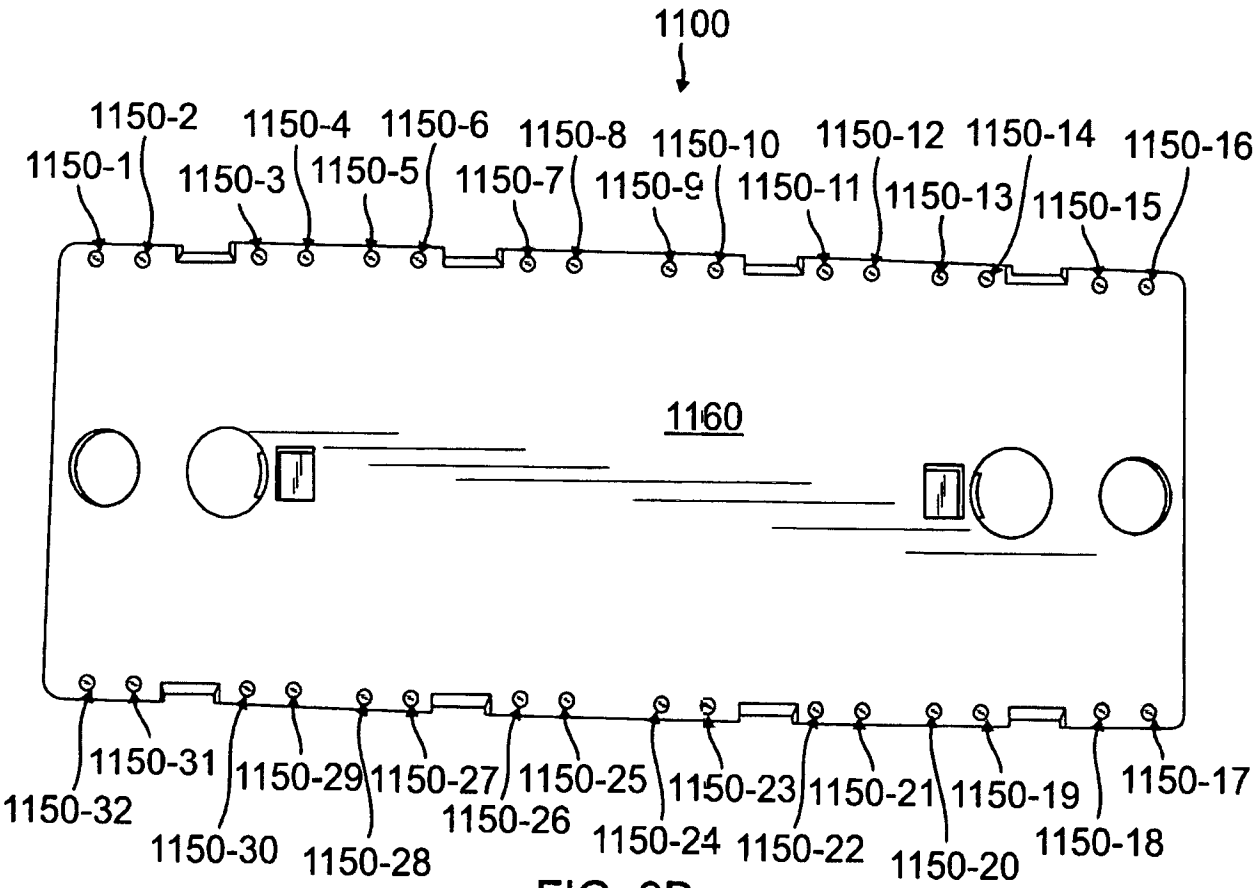
FIG. 9B is a bottom view of the embodiment of the mechanical plate of FIG. 9A.
Figure 10A:
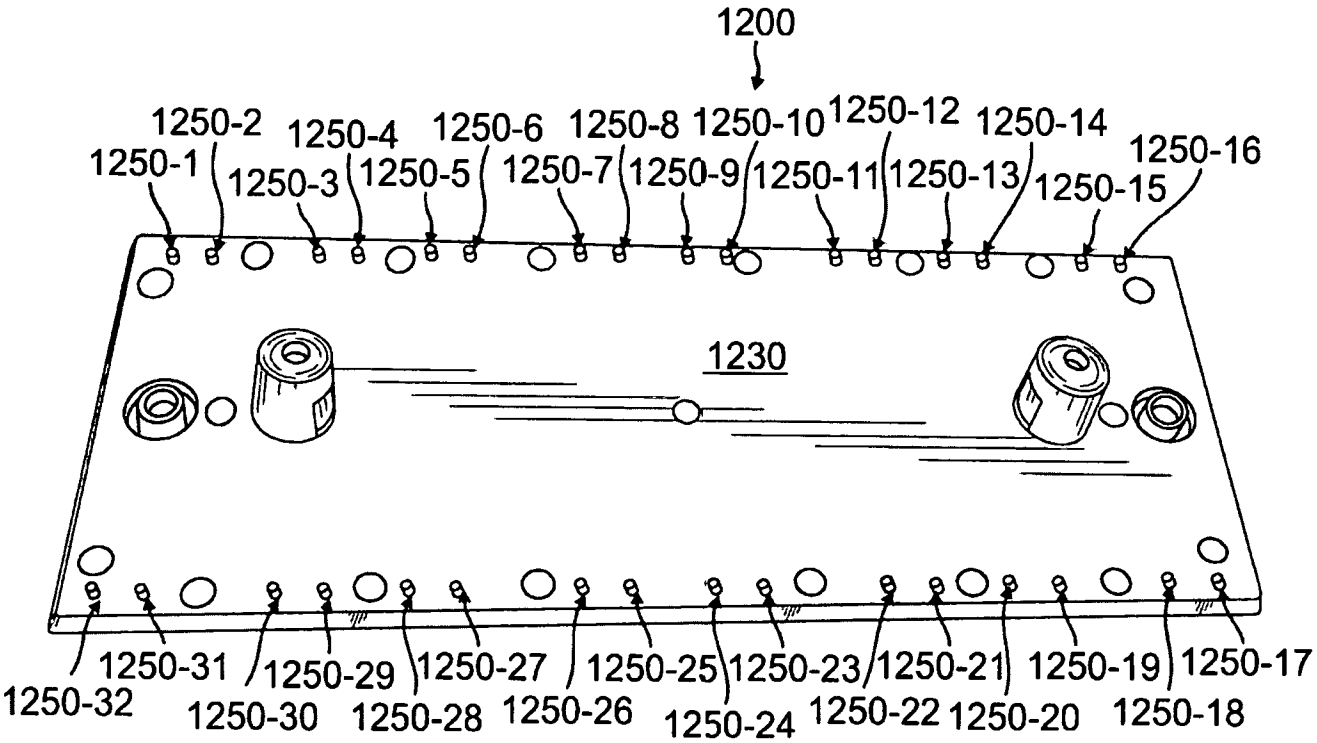
FIG. 10A is a top perspective view of another embodiment of the push plate.

Therefore, referring to FIGS. 9A, 9B and 10A, there is illustrated another embodiment mechanical plate 1100 having a top mechanical surface 1130 and a bottom mechanical surface 1160. Second embodiment mechanical plate 1100 has a bottom mechanical surface 1160 having 32 female mating members identified as 1150-1, 1150-2, 1150-3, 1150-4, 1150-5, 1150-6, 1150-7, 1150-8, 1150-9, 1150-10, 1150-11, 1150-12, 1150-13, 1150-14, 115015 1150-16, 1150-17, 1150-18, 1150-19, 1150-20, 1150-21, 1150-22, 1150-23, 1150-24, 11525, 1150-26, 1150-27, 1150-28, 1150-29, 1150-30, 1150-31 and 1150-32. Female mating members 1150-1 through 1150-32 mate with push plate male mating members (or teeth) 1250-1, 1250-2, 1250-3, 1250-4, 1250-5, 1250-6, 1250-7, 1250-8, 1250-9, 1250-10, 1250-11, 1250-12, 1250-13, 1250-14, 1250-15, 1250-16, 1250-17, 1250-18, 1250-19, 1250-20, 1250-21, 125022, 1250-23, 1250-24, 1250-25, 1250-26, 1250-27, 1250-28, 1250-29, 1250-30, 1250-31 and 1250-32 to retain cloth 1400 in between push plate 1200 and mechanical plate 1100.

Figure 10B:
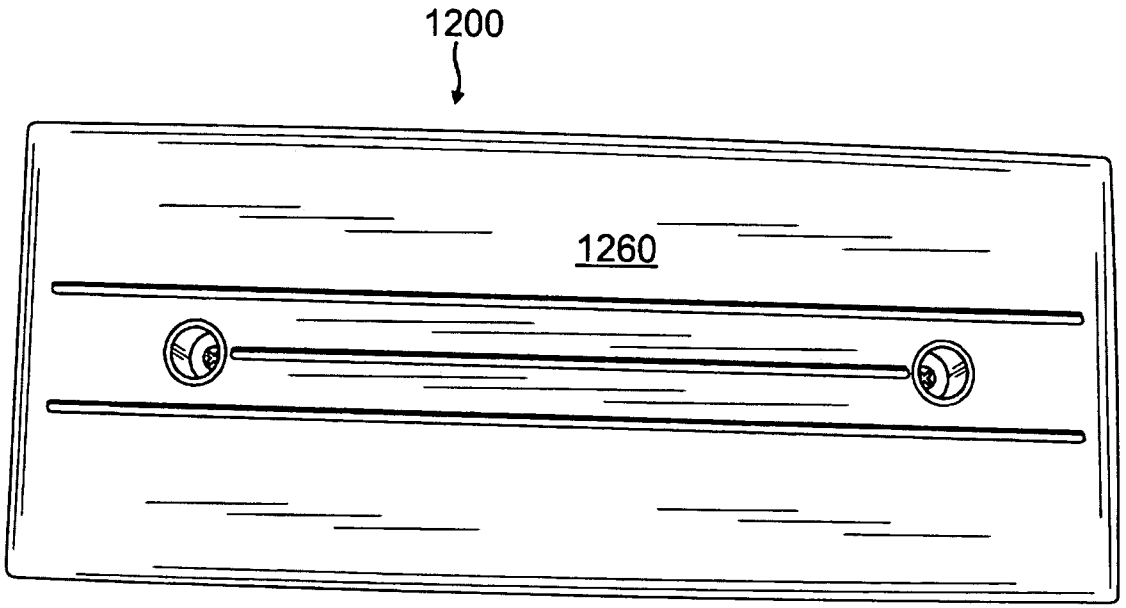
FIG. 10B is a bottom view of the embodiment of the push plate of FIG. 10A.
Figure 11A:
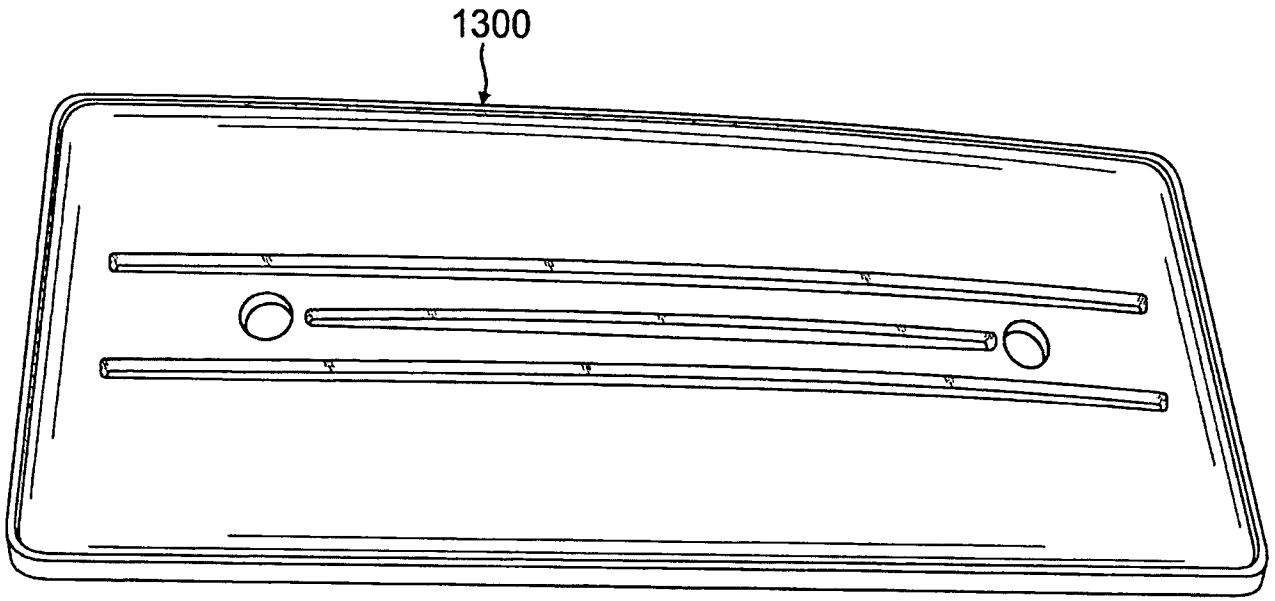
FIG. 11A is a top perspective view of a pad used with the embodiment of the push plate of FIG. 10A.
Figure 11B:
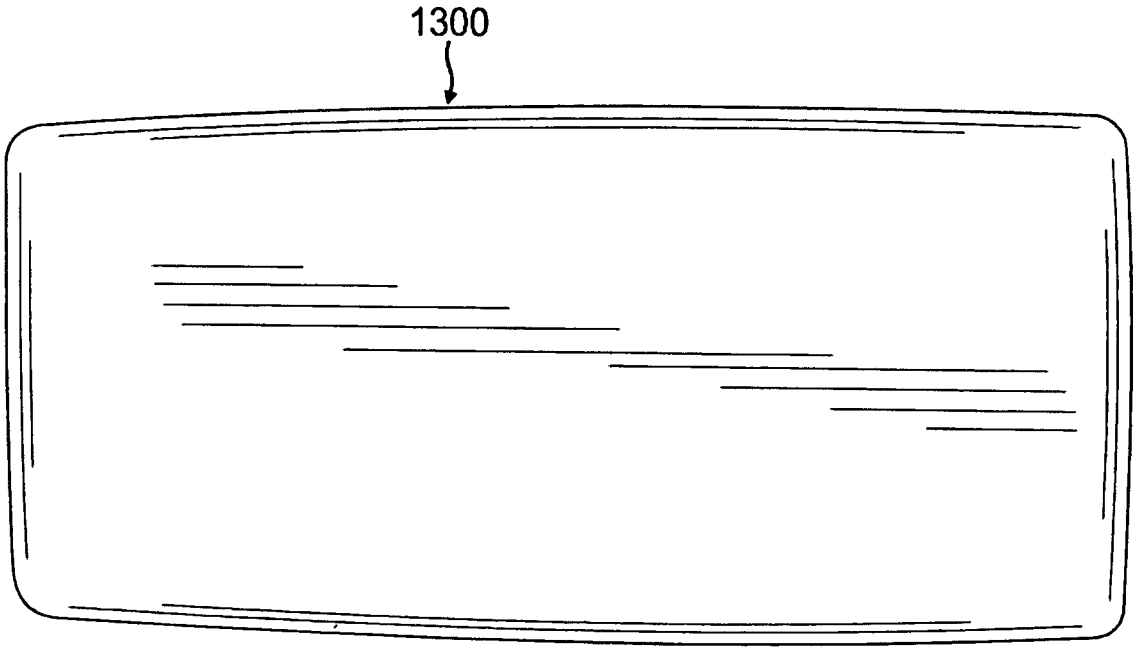
FIG. 11B is a bottom perspective view of a rubber pad used with the push plate.

As previously stated, all the other elements within the first described embodiment besides the method by which the non-woven cloth 1400 is retained remain the same between the first described embodiment and the second described embodiment. For completeness, FIG. 10B illustrating a bottom view of second described embodiment push plate 1200 having a push plate bottom surface 1260 is illustrated. Similarly, FIGS. 11A and 11B illustrate pad 1300.

Figures 1, 12:
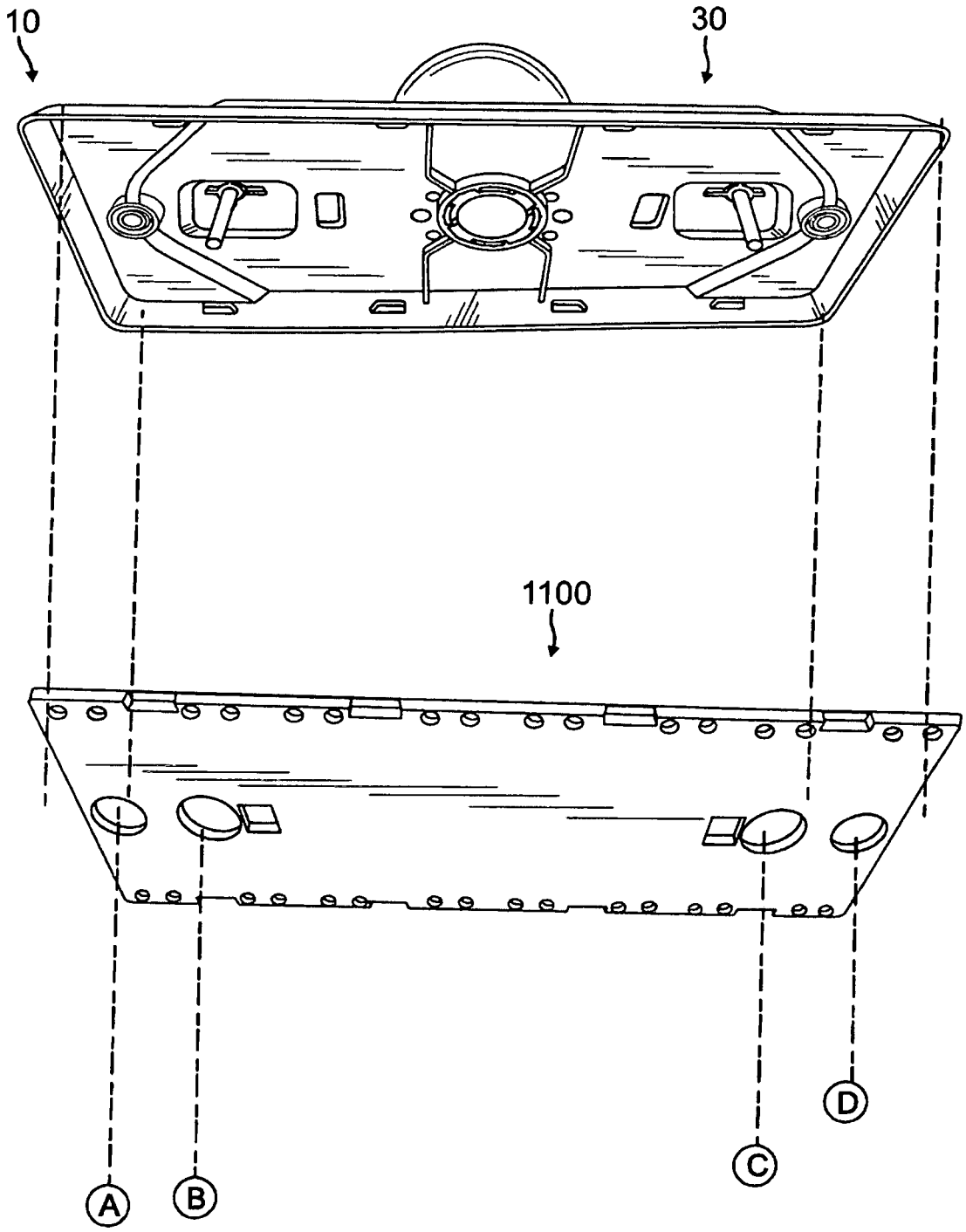
Figures 2, 12:
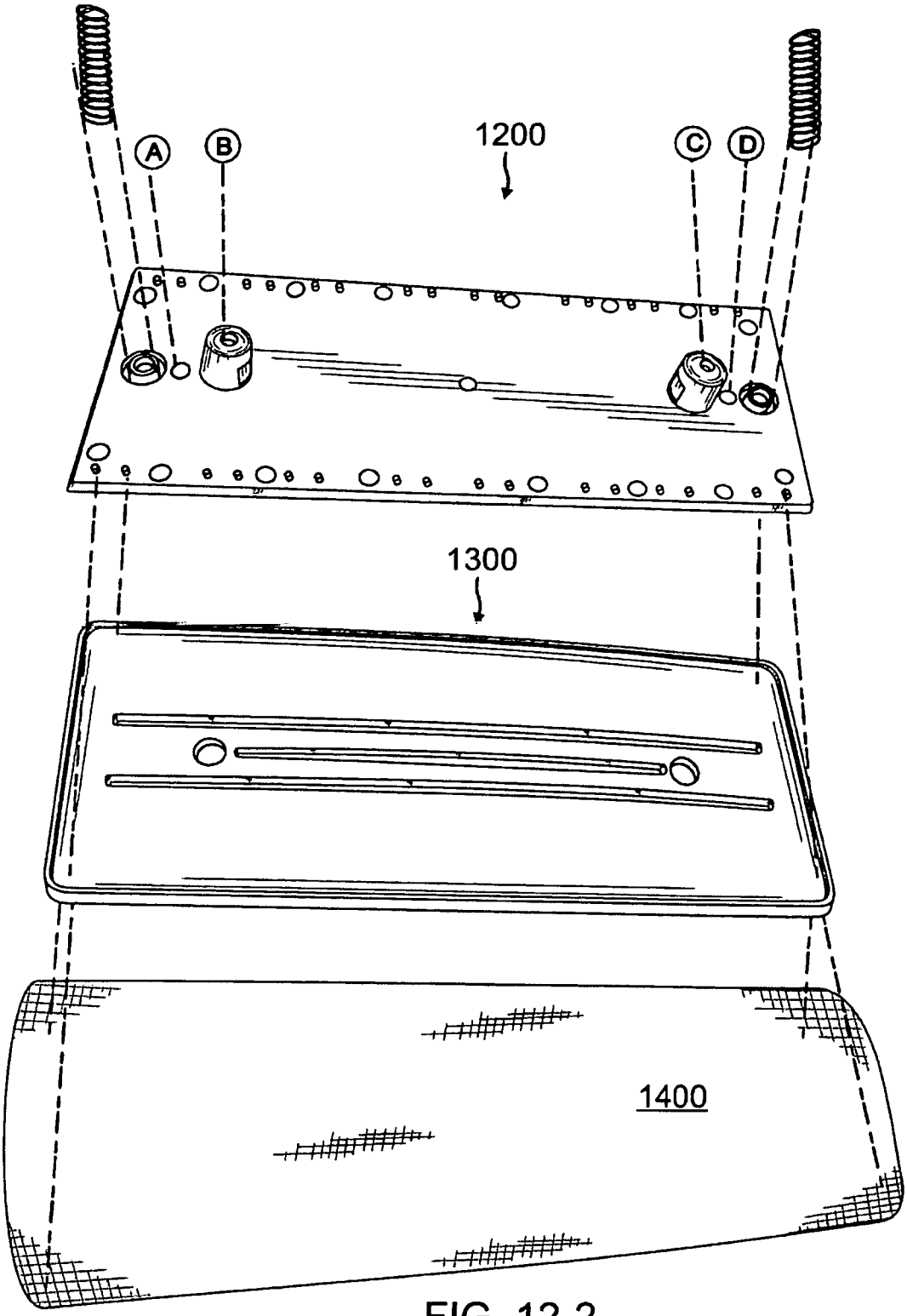

Referring to FIG. 12, there is illustrated an exploded view of the second described embodiment present invention flat mop with ball retaining member and dual trigger 10A. The second described embodiment includes the same top cover 30, mechanical plate 1100, push plate 1200 and pad (made material such as rubber or foam) 1300.

Figure 13:
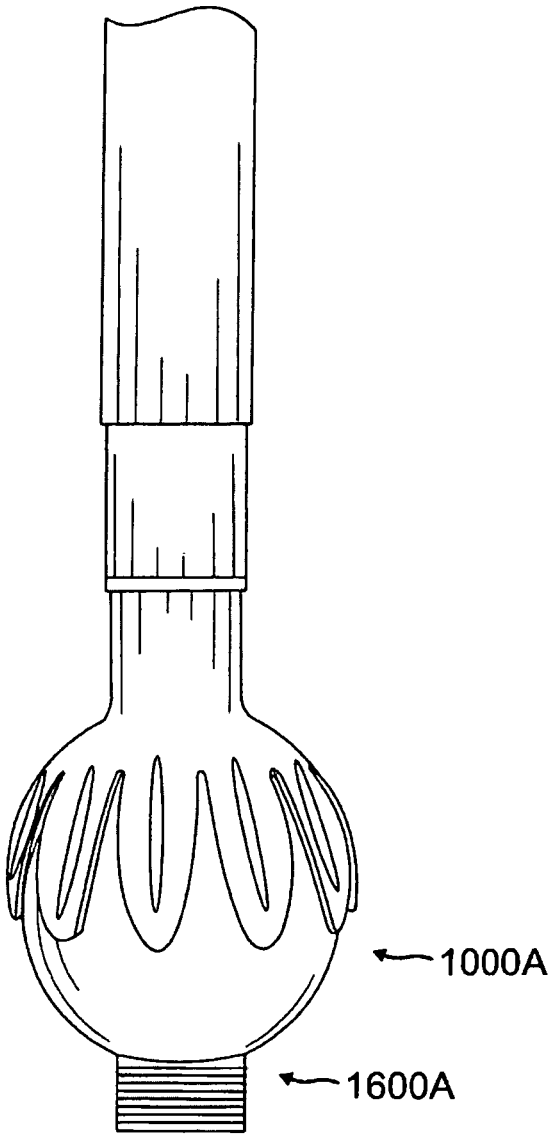
FIG. 13 is a side elevational view of the mop handle with the socket affixed to the bottom of the mop handle, the socket grasping/retaining the ball illustrating an alternative threaded bottom cylindrical threaded extension member on the ball.
Figure 14:
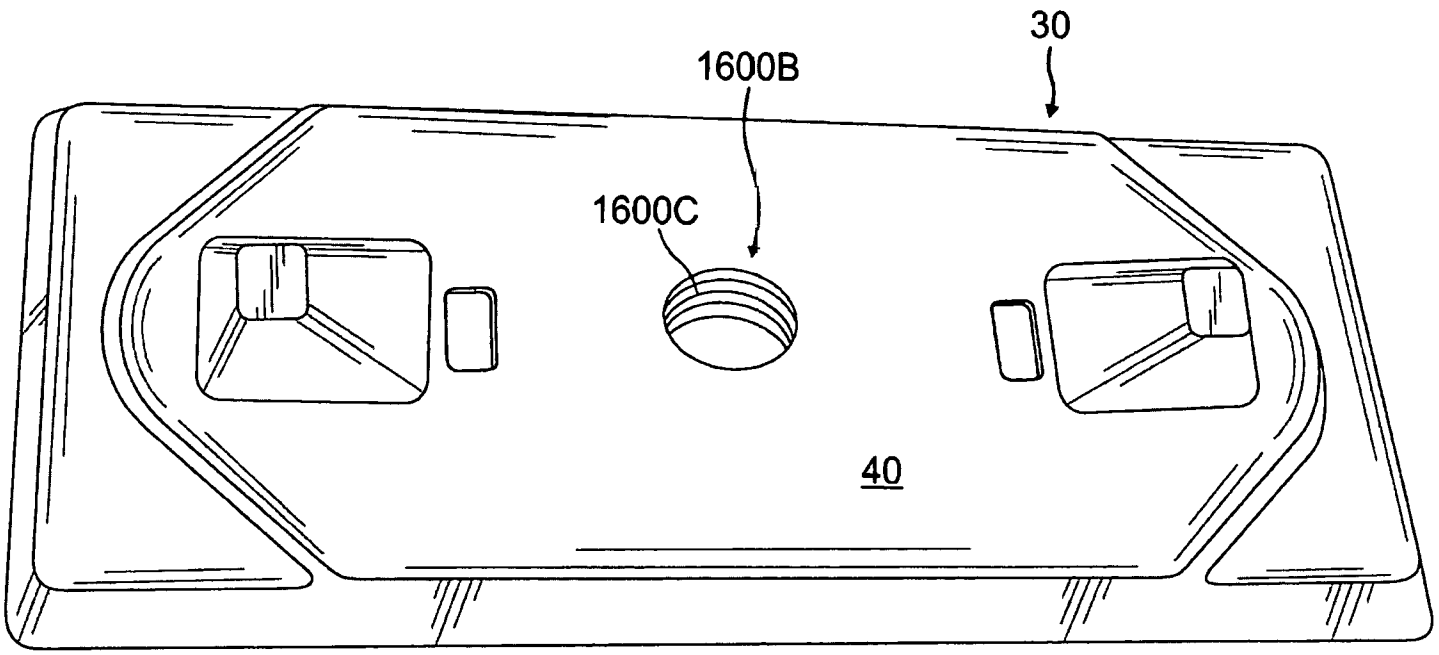
FIG. 14 is a top perspective view of the cover plate illustrating the threaded receiving opening in the top plate to receive the threaded extension member of the ball.

Referring to FIGS. 13 and 14, there is illustrated an alternative embodiment for the connection of the retaining ball to top cover 30. In this alternative embodiment, retaining ball 1000A has threads 1600A that can be either male threads or female threads that affix to the threaded receiving opening 1600B of top cover 30 by male or female mating threads 1600C.

Figure 15:
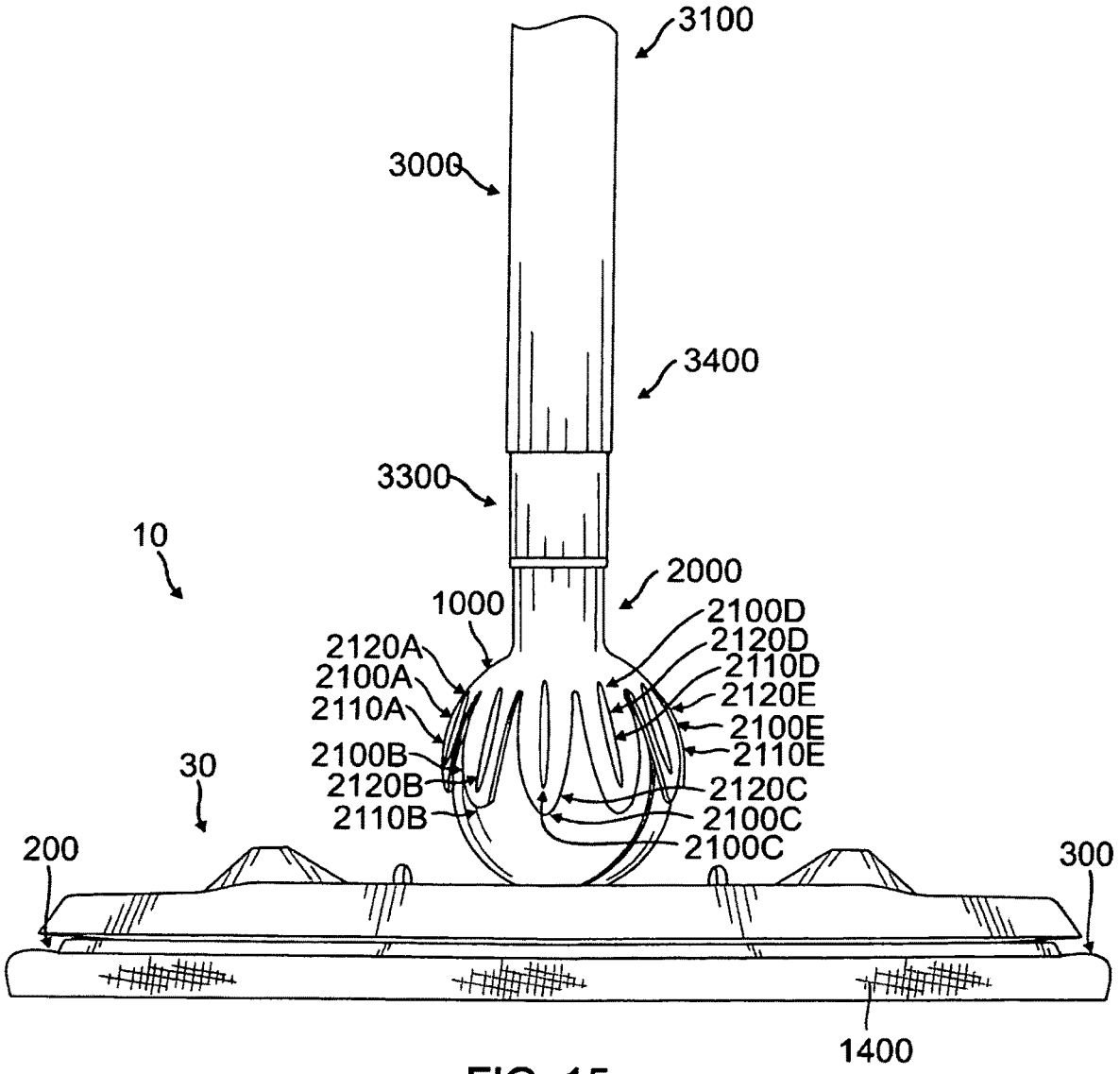
FIG. 15 is a side elevational view of one embodiment of the ball affixed to the top plate and a socket attached to the bottom of the mop handle with the socket grasping the ball also illustrating the flat mop in the unactivated condition.

FIG. 15 is a side elevational view of the present invention ball affixed to the top plate and a socket attached to the bottom of the mop handle with the socket grasping the ball 10A and also illustrating the flat mop in the unactivated condition.

Figure 16:
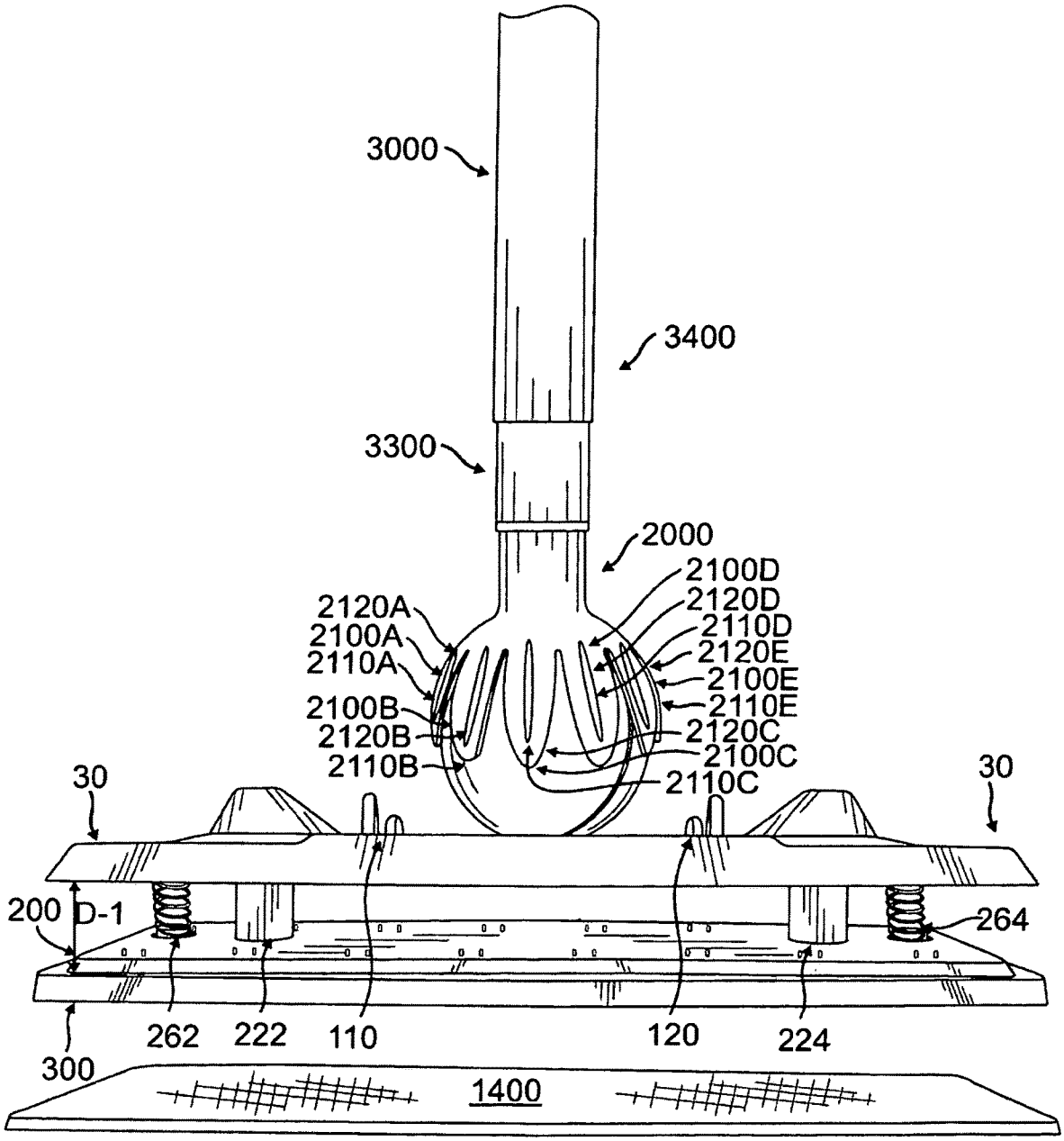
FIG. 16 is an exploded side perspective view of the ball affixed to the top plate and a socket attached to the bottom of the mop handle with the socket grasping the ball also illustrating the flat mop in the activated condition.

FIG. 16 is an exploded side perspective view of the present invention ball affixed to the top plate and a socket attached to the bottom of the mop handle 10A with the socket grasping the ball also illustrating the flat mop in the activated condition.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The invention claimed is:

1. A mop, comprising:

an elongated handle having a socket assembly affixed to a first end thereof;

a plurality of grasping members extending from the socket assembly;

a stationary plate removably attachable to the elongated handle;

a ball assembly extending from a top portion of the stationary plate, the ball assembly being configured to engage the grasping members to achieve the removable attachment to the elongated handle;

a trigger mechanism positioned along the top portion of the stationary plate, the trigger mechanism being movable relative to the ball assembly, the trigger mechanism including a first trigger activation member and a second trigger activation member each of which is spaced apart from the ball assembly;

a push plate movably coupled to the stationary plate, the push plate being configured to move from a first position proximate the stationary plate to a second position axially away from the stationary plate in response to activation of the trigger mechanism, wherein the first trigger activation member and the second trigger activation member each extend through the stationary plate and movement of each of the first trigger activation member and the second trigger activation member towards the ball assembly moves the push plate from the first position to the second position; and a substrate removably coupled to the push plate, wherein the substrate is configured to decouple from the push plate once the push plate is moved to the second position in response to activation of the trigger mechanism.

2. The mop of claim 1, wherein movement of the push plate is substantially perpendicular to sliding movement of each of the first trigger activation member and the second activation member toward the ball assembly.

3. The mop of claim 1, further comprising a compression spring configured to move the push plate between the first and second positions in response to activation of the trigger mechanism.

4. The mop of claim 1, further comprising a pad positioned on a bottom surface of the push plate, the pad being configured to removably couple to the substrate.

5. The mop of claim 4, wherein the substrate comprises a cloth substrate.

6. The mop of claim 5, wherein the cloth substrate is a microfiber cloth that is configured to couple to the pad via hook fasteners.

7. The mop of claim 1, wherein the substrate is configured to decouple from the push plate in response to activation of the trigger mechanism and without the substrate being touched by a user during the activation process.

8. The mop of claim 1, further comprising a mechanical plate retained on a bottom portion of the stationary plate by mating notch members on the longitudinal sidewalls of the mechanical plate and tooth members along the bottom longitudinal walls of the stationary plate.

9. The mop of claim 8, wherein the mechanical plate further comprises a first ratchet collar opening adjacent a first tooth member and a second ratchet collar opening adjacent a second tooth member.

10. The mop of claim 1, wherein the ball assembly is configured to engage the socket assembly via a press fit engagement.

11. The mop of claim 1, wherein the ball assembly is centrally positioned along the top portion of the stationary plate.

12. The mop of claim 11, wherein each of the first trigger activation member and the second trigger activation member is positioned equidistant from the ball assembly in opposite directions.

13. The mop of claim 12, wherein the first trigger activation member and the second trigger activation member are located along a longitudinal lengthwise center of the stationary plate.

14. The mop of claim 13, wherein at least one of the first trigger activation member and the second trigger activation member includes a flexible wing to resist a force applied at the first trigger activation member or the second trigger activation member.

* * * * *